US010490964B2

(12) United States Patent
Ikebe et al.

(10) Patent No.: US 10,490,964 B2
(45) Date of Patent: Nov. 26, 2019

(54) METHOD OF MANUFACTURING CRIMPING TERMINAL

(71) Applicant: Yazaki Corporation, Tokyo (JP)

(72) Inventors: Koichi Ikebe, Shizuoka (JP); Masashi Iwata, Shizuoka (JP); Junya Shinohara, Shizuoka (JP); Hirohito Nakata, Shizuoka (JP); Hideki Saito, Shizuoka (JP); Syunsuke Yaoita, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 61 days.

(21) Appl. No.: 15/714,700

(22) Filed: Sep. 25, 2017

(65) Prior Publication Data

US 2018/0109059 A1 Apr. 19, 2018

(30) Foreign Application Priority Data

Oct. 13, 2016 (JP) ..... 2016-201872

(51) Int. Cl.
*H01R 43/02* (2006.01)
*H01R 43/16* (2006.01)
(Continued)

(52) U.S. Cl.
CPC ..... *H01R 43/16* (2013.01); *H01R 4/20* (2013.01); *H01R 4/185* (2013.01); *Y10T 29/49208* (2015.01)

(58) Field of Classification Search
CPC ..... H01R 43/16; H01R 43/005; H01R 4/20; H01R 4/185; H01R 9/0518;
(Continued)

(56) References Cited

U.S. PATENT DOCUMENTS 3,648,224 A * 3/1972 McDonough ..... H01R 9/0518 29/874
8,641,461 B2 * 2/2014 Mitose ..... H01R 4/185 439/587
(Continued)

FOREIGN PATENT DOCUMENTS

CN 101227052 A 7/2008
CN 104969415 A 10/2015
(Continued)

OTHER PUBLICATIONS

Japanese Office Action for the related Japanese Patent Application No. 2016-201872 dated Jan. 8, 2019.
(Continued)

*Primary Examiner* — Donghai D Nguyen
(74) *Attorney, Agent, or Firm* — Kenealy Vaidya LLP

(57) ABSTRACT

A method of manufacturing a crimping terminal includes a punching process of punching out a crimping terminal from a flat-plate-shaped metal base material, an attaching process of attaching a sheet-like water stop member to a wire connection portion being a portion in the crimping terminal that is to be crimped onto a wire, and a bending process of bending the wire connection portion to which the water stop member is attached. The wire connection portion may integrally cover a core wire and a covering of the wire by being crimped onto the wire.

4 Claims, 17 Drawing Sheets

(51) Int. Cl.
*H01R 4/20* (2006.01)
*H01R 4/18* (2006.01)

(58) Field of Classification Search
CPC ..... Y10T 29/49181; Y10T 29/49185; Y10T 29/49204; Y10T 29/4921
USPC ..... 29/857, 861, 863, 874, 877; 439/587
See application file for complete search history.

(56) References Cited

U.S. PATENT DOCUMENTS

| | | | | |
|---|---|---|---|---|
| 9,755,327 | B2 * | 9/2017 | Aoki | H01R 4/185 |
| 2008/0172866 | A1 | 7/2008 | Yagi et al. | |
| 2015/0020384 | A1 | 1/2015 | Yamamoto | |
| 2015/0340772 | A1 | 11/2015 | Kawamura et al. | |
| 2016/0141768 | A1 | 5/2016 | Aoki et al. | |
| 2016/0359244 | A1 | 12/2016 | Tachibana | |
| 2017/0005417 | A1 | 1/2017 | Aoki et al. | |
| 2017/0179620 | A1 | 6/2017 | Shinohara et al. | |

FOREIGN PATENT DOCUMENTS

| | | | |
|---|---|---|---|
| CN | 105379020 | A | 3/2016 |
| CN | 105453342 | A | 3/2016 |
| CN | 107039783 | A | 8/2017 |
| JP | 2013-218815 | | 10/2013 |
| JP | 2014-164952 | A | 9/2014 |
| JP | 2015-26444 | A | 2/2015 |
| JP | 2015-65145 | A | 4/2015 |
| JP | 2015-201269 | A | 11/2015 |
| JP | 2016-81611 | A | 5/2016 |
| JP | 2017-50151 | A | 3/2017 |

OTHER PUBLICATIONS

Chinese Office Action for the related Chinese Patent Application No. 201710947723.6 dated Jan. 16, 2019.

* cited by examiner

METHOD OF MANUFACTURING CRIMPING TERMINAL

CROSS-REFERENCE TO RELATED APPLICATION(S)

The present application claims priority to and incorporates by reference the entire contents of Japanese Patent Application No. 2016-201872 filed in Japan on Oct. 13, 2016.

BACKGROUND OF THE INVENTION

1. Field of the Invention

The present invention relates to a method of manufacturing a crimping terminal.

2. Description of the Related Art

There has been conventionally a crimping terminal in which water is stopped by a water stop member. For example, Japanese Patent Application Laid-open No. 2015-201269 discloses a technique of a connection structure of a crimping terminal and a wire that includes a crimping terminal in which a conductive member crimping portion that crimps a conductive member of the wire and a covering crimping portion that crimps the wire from an outer circumference of a covering are consecutively installed, and a wire connection portion to be crimped to the wire is provided, and a water stop sheet having a size surrounding the conductive member to be crimped and the covering, and being interposed between the wire connection portion and the wire.

Here, it is desired in the crimping terminal that a decrease in water stop performance can be suppressed. For example, when the water stop member is a sheet-like adhesive to be attached to the crimping terminal, if the water stop member fails to be appropriately attached to the crimping terminal, a decrease in water stop performance is easily caused.

SUMMARY OF THE INVENTION

The object of the present invention is to provide a method of manufacturing a crimping terminal that can suppress a decrease in water stop performance in a crimping terminal.

According to one aspect of the present invention, a method of manufacturing a crimping terminal includes a punching process of punching out a crimping terminal from a flat-plate-shaped metal base material; an attaching process of attaching a sheet-like adhesive material to a wire connection portion being a portion in the crimping terminal that is to be crimped onto a wire; and a bending process of bending the wire connection portion to which the adhesive material is attached.

According to another aspect of the present invention, in the method of manufacturing the crimping terminal, it is preferable that the wire connection portion integrally covers a core wire and a covering of the wire by being crimped onto the wire, and in the attaching process, the adhesive material is attached to a rim portion in the wire connection portion along a longitudinal direction of the wire connection portion, and rim portions at both ends in the longitudinal direction of the wire connection portion.

According to still another aspect of the present invention, in the method of manufacturing the crimping terminal, it is preferable that the crimping terminal includes a terminal connection portion to be electrically-connected to a counterpart terminal, and a joint portion linking the terminal connection portion and the wire connection portion, and in the bending process, the wire connection portion and the joint portion are concurrently bent.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A method of manufacturing a crimping terminal according to an embodiment of the present invention will be described in detail below with reference to the drawings. In addition, the present invention is not limited by the embodiment. In addition, components in the following embodiment include the ones easily-conceived by those skilled in the art, or the ones that are substantially identical.

Embodiment

Figure 12:
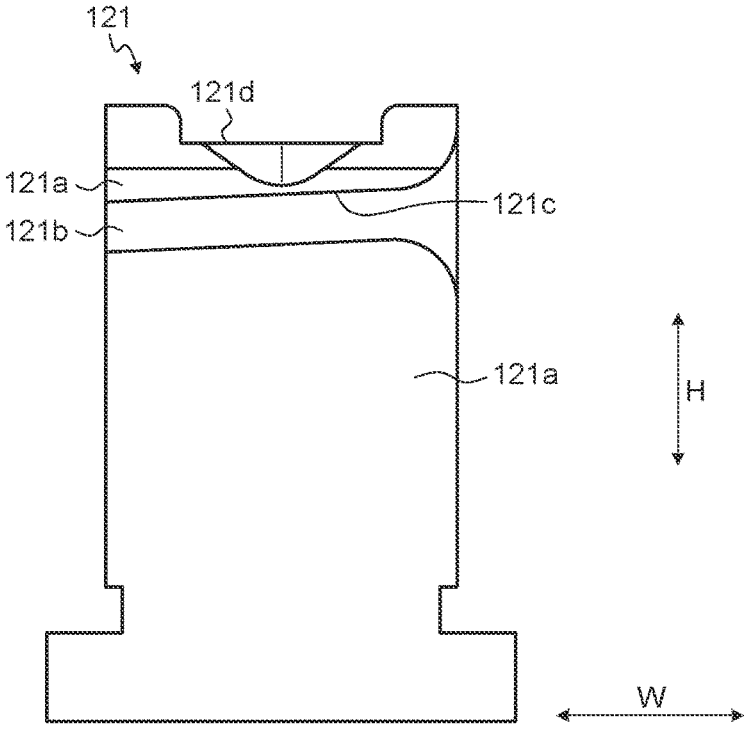
FIG. 12 is a rear view illustrating the terminal cutting member according to the embodiment.
Figure 13:
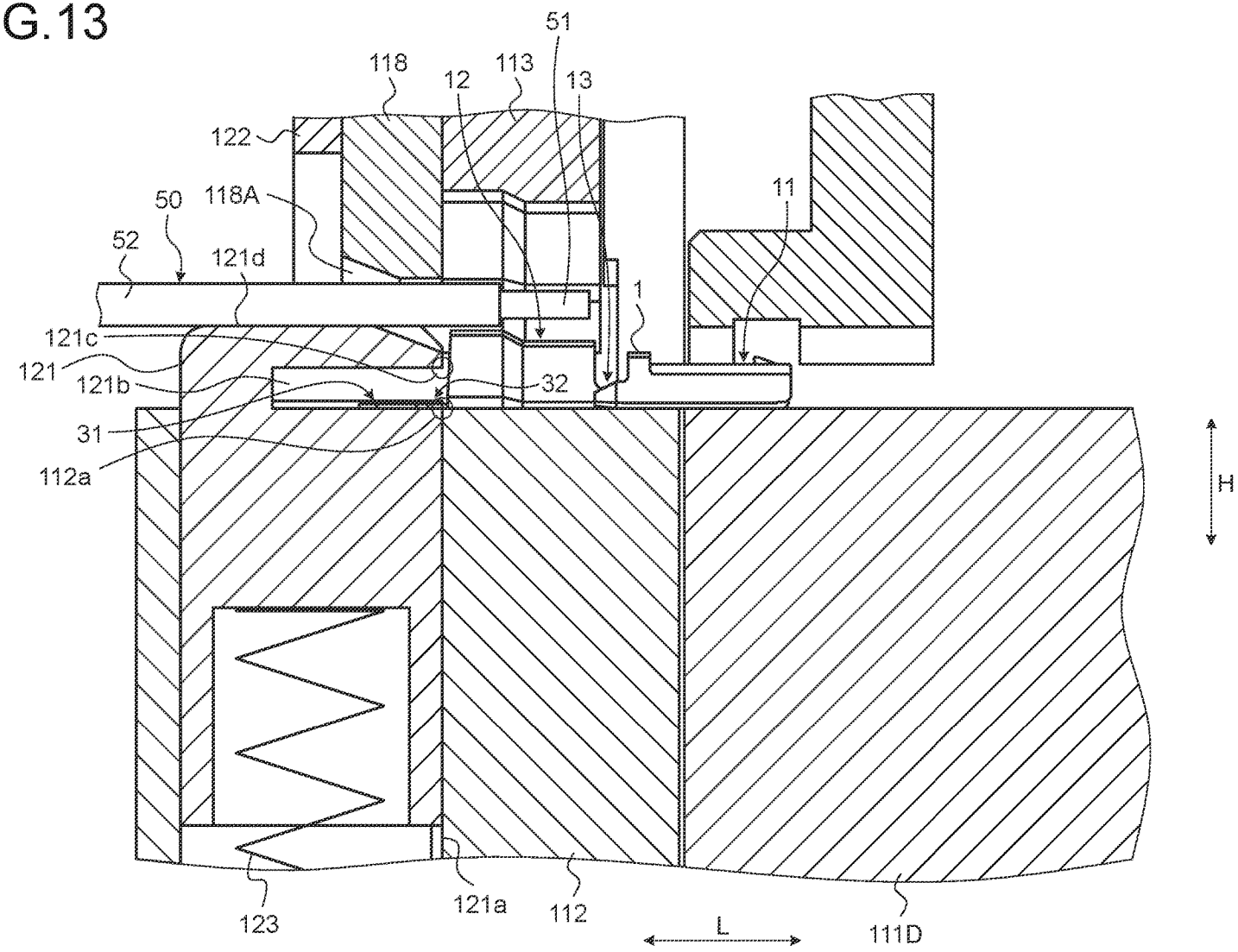
FIG. 13 is a cross-sectional view illustrating a state in which a wire and the crimping terminal are set in the terminal crimping apparatus according to the embodiment.

An embodiment will be described with reference to FIGS. 1 to 20. The present embodiment relates to a method of manufacturing a crimping terminal. In addition, FIG. 13 illustrates a XIII-XIII cross section in FIG. 9.

First of all, a crimping terminal 1 according to the present embodiment will be described. The crimping terminal 1 illustrated in FIG. 1 and the like is a terminal to be crimped onto a wire 50. The crimping terminal 1 is electrically-connected to counterpart terminal (not illustrated) in a state of being integrated with the wire 50. A covering 52 at an end portion of the crimping target wire 50 is removed, and a core wire 51 is exposed by a predetermined length. The core wire 51 may be an aggregate of a plurality of wires, or may be a single wire such as a coaxial cable. By being crimped to the end portion of the wire 50, the crimping terminal 1 is electrically-connected to the exposed core wire 51.

The crimping terminal 1 includes a terminal fitting 10 and a water stop member 20. The terminal fitting 10 is a main portion of the crimping terminal 1. The terminal fitting 10 is formed of a conductive metal plate serving as a base material (e.g., copper plate, copper alloy plate). The terminal fitting 10 is formed into a predetermined shape that enables connection to the counterpart terminal and the wire 50, through punching processing, bending processing, and the like that are performed on the base material. The terminal fitting 10 includes a terminal connection portion 11 and a wire connection portion 12. The terminal connection portion 11 is a portion to be electrically-connected to the counterpart terminal. The wire connection portion 12 is a portion to be crimped onto the wire 50, and is electrically-connected to the core wire 51. A joint portion 13 is provided between the terminal connection portion 11 and the wire connection portion 12. In other words, the terminal connection portion 11 and the wire connection portion 12 are joined via the joint portion 13. The joint portion 13 includes side walls 13*a* and 13*a* that link side walls 11*a* and 11*a* of the terminal connection portion 11 and barrel piece portions 15 and 16 being side walls of the wire connection portion 12. One side wall 13*a* links one side wall 11*a* and a first barrel piece portion 15, and the other side wall 13*a* links the other side wall 11*a* and a second barrel piece portion 16. A height of the side walls 13*a* is lower than heights of the barrel piece portions 15 and 16, and the side walls 11*a*. More specifically, the height of the side walls 13*a* becomes lower from the terminal connection portion 11 toward the wire connection portion 12.

The terminal fitting 10 may be a male terminal or a female terminal. When the terminal fitting 10 is a male terminal, the terminal connection portion 11 is molded into a male die, and when the terminal fitting 10 is a female terminal, the terminal connection portion 11 is molded into a female die.

In the description of the crimping terminal 1, a direction in which the crimping terminal 1 is connected to the counterpart terminal, that is, a direction in which the crimping terminal 1 is inserted into the counterpart terminal will be referred to as a first direction L. The first direction L is a longitudinal direction of the crimping terminal 1. A parallel arrangement direction of the crimping terminals 1 will be referred to as a second direction W. As described later, the parallel arrangement direction is a direction in which the crimping terminals 1 are arranged in parallel in a terminal chain member 30, and is a width direction of the crimping terminal 1. In the crimping terminal 1, a direction perpendicular to both of the first direction L and the second direction W will be referred to as a third direction H. The third direction H is a height direction of the crimping terminal 1.

Figure 5:
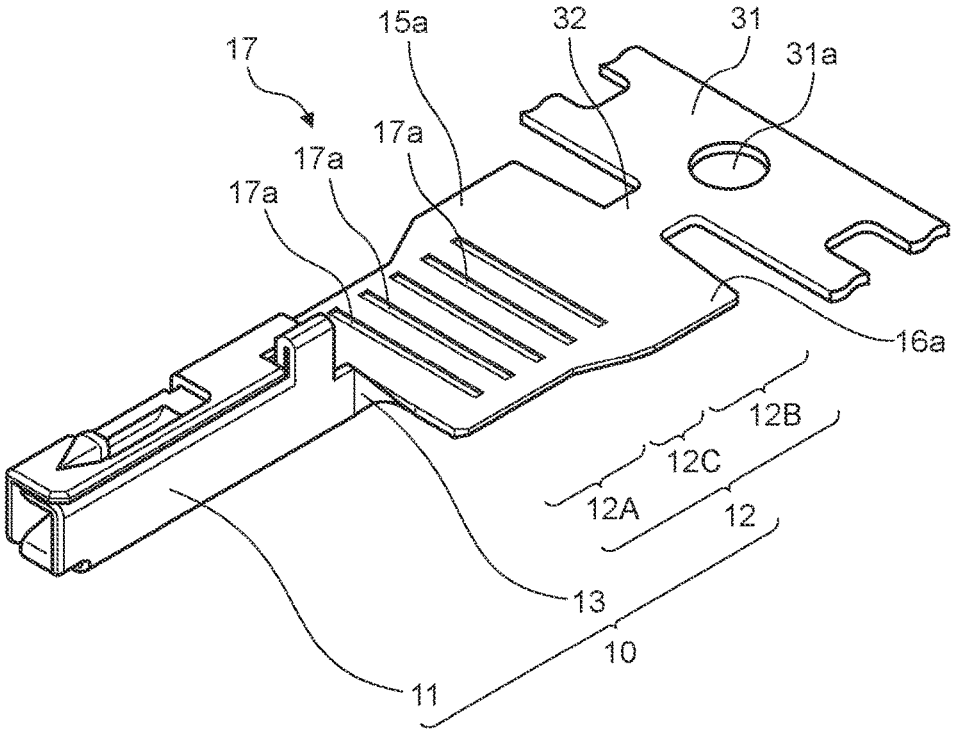
FIG. 5 is a perspective view illustrating a state before an attaching process is executed in the crimping terminal according to the embodiment.

A shaping process includes a terminal connection portion shaping process and a wire connection portion shaping process. In the terminal connection portion shaping process, the terminal connection portion 11 is formed into a tubular shape as illustrated in FIG. 5. In the terminal connection portion shaping process, the bending processing and the like are performed on the terminal connection portion 11. The terminal connection portion 11 of the present embodiment is formed into a tubular shape having an oblong cross-sectional shape. In a wire connection portion shaping process, the wire connection portion 12 is molded so as to have a U-shaped cross-sectional shape. In the wire connection portion shaping process, the bending processing and the like are performed on the wire connection portion 12. In addition, the water stop member 20 is attached to the wire connection portion 12 in an attaching process. The attaching process is executed before the wire connection portion shaping process.

Figure 1:
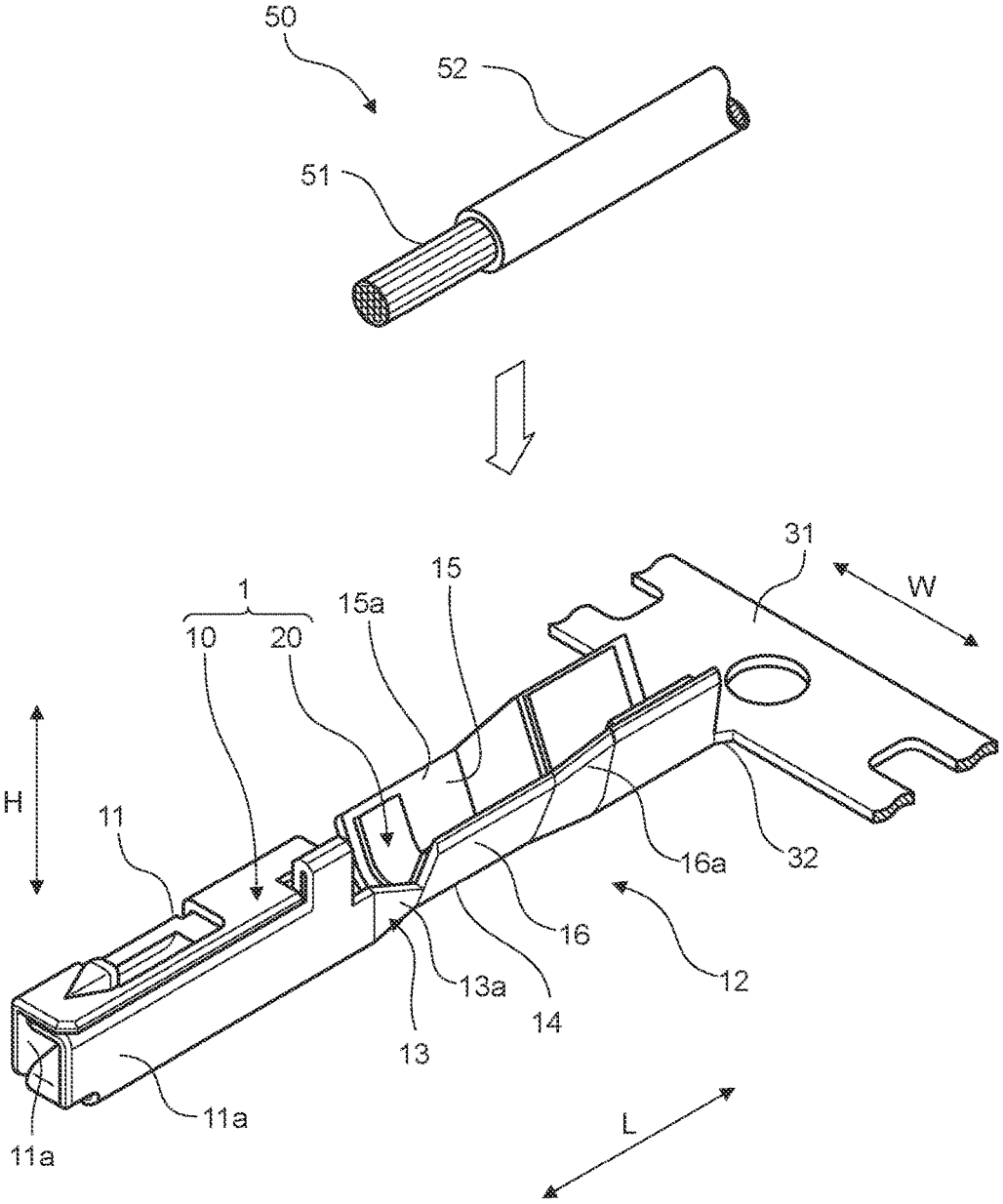
FIG. 1 is a perspective view illustrating a state before crimping of a crimping terminal according to an embodiment.
Figure 2:
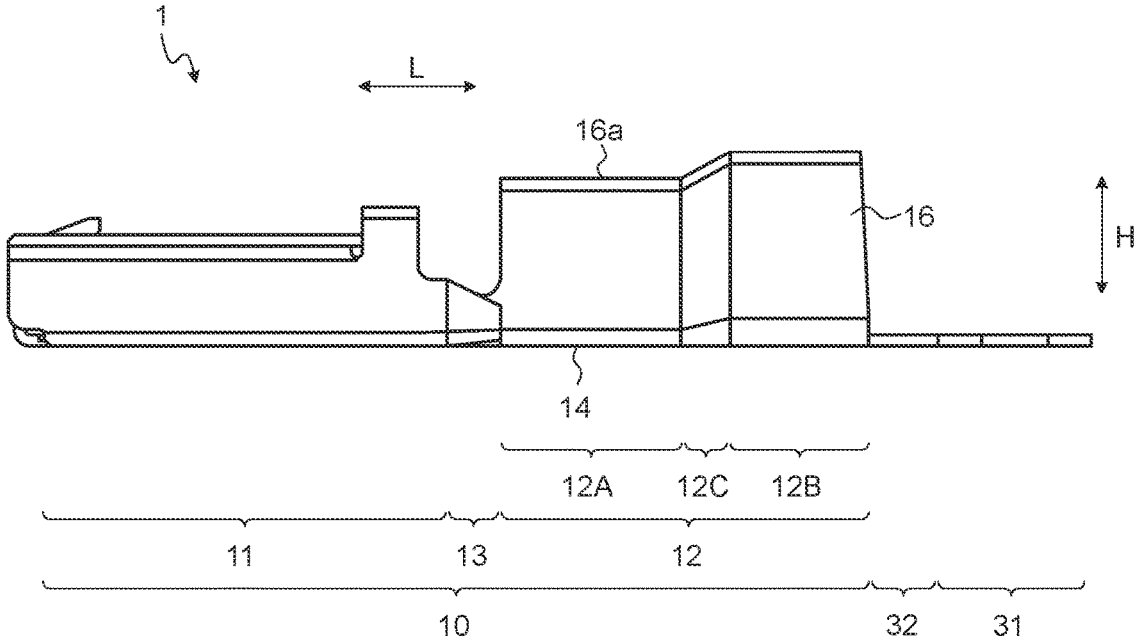
FIG. 2 is a side view illustrating a state before crimping of the crimping terminal according to the embodiment.
Figure 3:
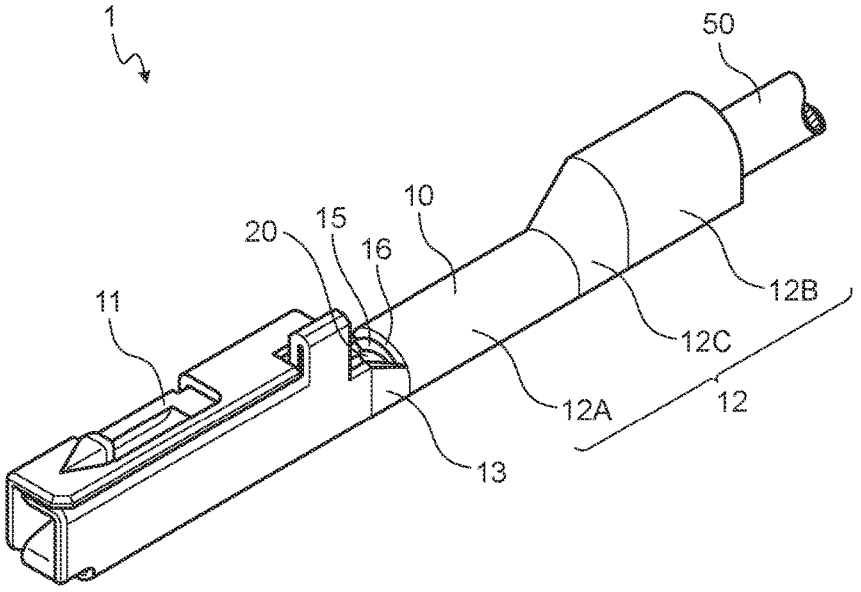
FIG. 3 is a perspective view illustrating the crimping terminal according to the embodiment that is obtainable after crimping.
Figure 4:
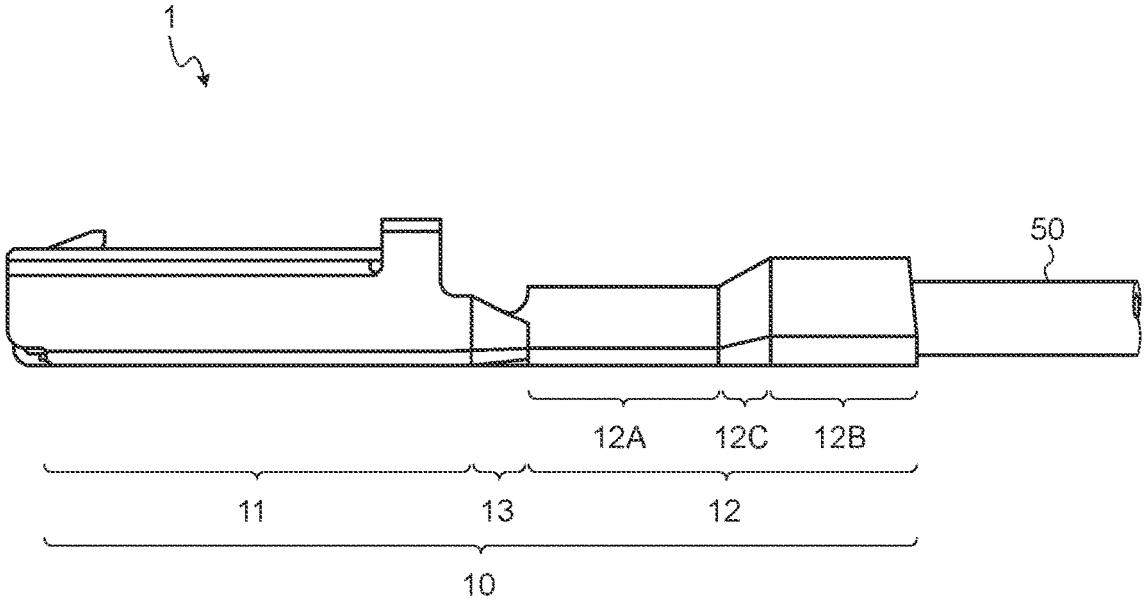
FIG. 4 is a side view illustrating the crimping terminal according to the embodiment that is obtainable after crimping.
Figure 6:
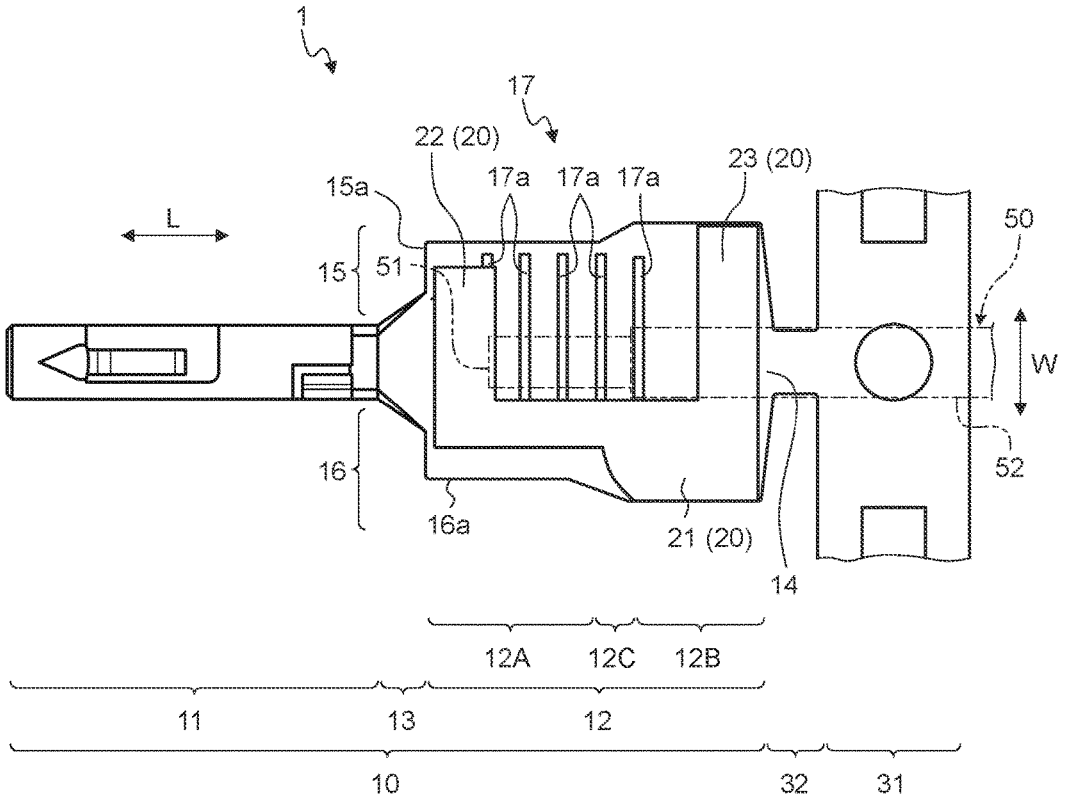
FIG. 6 is a plan view illustrating a state in which a water stop member is attached in the crimping terminal according to the embodiment.

As illustrated in FIGS. 1 and 6, the wire connection portion 12 includes a bottom portion 14, the first barrel piece portion 15, and the second barrel piece portion 16. The bottom portion 14 is a region serving as a bottom wall of the wire connection portion 12 formed into the U-shape. In crimping processing, the end portion of the wire 50 is placed on the bottom portion 14. The first barrel piece portion 15 and the second barrel piece portion 16 are regions serving as side walls of the wire connection portion 12 formed into the U-shape. The first barrel piece portion 15 and the second barrel piece portion 16 are connected to end portions in the second direction W of the bottom portion 14. The first barrel piece portion 15 and the second barrel piece portion 16 protrude from the end portions in the width direction of the bottom portion 14, toward directions intersecting with the width direction. In the wire connection portion 12 formed into the U-shape, when the end portion of the wire 50 is placed on the bottom portion 14, the first barrel piece portion 15 and the second barrel piece portion 16 surround the wire 50 from both sides in the second direction W.

Lengths from roots on the bottom portion 14 side to end surfaces of distal ends 15*a* and 16*a* of the first barrel piece portion 15 and the second barrel piece portion 16 may be equal to each other, or one length may be longer than the other length. In the crimping terminal 1 of the present embodiment, the length from the root to the distal end 16*a* of the second barrel piece portion 16 is longer than the length from the root to the distal end 15*a* of the first barrel piece portion 15. For example, the first barrel piece portion 15 and the second barrel piece portion 16 are winded around the wire 50 while overlapping each other. In the present embodiment, the second barrel piece portion 16 overlaps on the outside of the first barrel piece portion 15. In addition, swaging referred to as so-called B crimping may be performed on the first barrel piece portion 15 and the second barrel piece portion 16. In the B crimping, both of the first barrel piece portion 15 and the second barrel piece portion 16 are bent toward the bottom portion 14 side, and swaged so that the distal ends 15*a* and 16*a* are pressed against the wire 50. Because the crimping terminal 1 of the present embodiment is provided with the water stop member 20 to be described later, the former swaging processing is employed.

The end portion of the wire 50 is inserted into a U-shaped inner space from a U-shaped opening portion of the wire connection portion 12, that is, from a clearance gap between the distal ends 15*a* and 16*a*. The wire connection portion 12 is formed so that the end portion of the wire 50 can be easily inserted. More specifically, in the wire connection portion 12, a distance in the second direction W between the first barrel piece portion 15 and the second barrel piece portion 16 widens from the bottom portion 14 side toward the end surfaces of the distal ends 15*a* and 16*a*.

As illustrated in FIGS. 2 to 6, in the first barrel piece portion 15 and the second barrel piece portion 16, a joint crimping portion 12C interposes between a core wire crimping portion 12A and a covering crimping portion 12B. Each of the first barrel piece portion 15 and the second barrel piece portion 16 is one piece portion in which the crimping portions 12A, 12C, and 12B are consecutively arranged in the first direction L in this order.

The core wire crimping portion 12A is a region to be crimped onto the core wire 51 at the distal end of the wire 50. The core wire crimping portion 12A is a region closest to the joint portion 13 in each of the barrel piece portions 15 and 16. The covering crimping portion 12B is a region to be crimped onto an end portion of the covering 52. The covering crimping portion 12B is a region positioned on the farthest side from the joint portion 13 side in each of the barrel piece portions 15 and 16. The joint crimping portion 12C is a region linking the core wire crimping portion 12A and the covering crimping portion 12B. The joint crimping portion 12C is crimped onto a boundary portion between the core wire 51 and the covering 52 of the wire 50. By being crimped onto the wire 50, the wire connection portion 12 integrally covers the core wire 51 and the covering 52.

As illustrated in FIGS. 5 and 6, a serration region 17 is provided on an inner wall surface of the wire connection portion 12, that is, on a wall surface on the side covering the wire 50. The serration region 17 is a core wire holding region for holding the core wire 51. The serration region 17 is a region on the inner wall surface of the wire connection portion 12 that includes a portion to be winded around the core wire 51. A plurality of recessed portions, a plurality of projection portions, or combinations of recessed portions and projection portions are arranged on the serration region 17. The recessed portions and the projection portions increase a contact area between the wire connection portion 12 and the core wire 51 to enhance the strength of adhesion therebetween. The serration region 17 of the present embodiment is an oblong region, and a plurality of recessed portions 17*a* are formed at positions different from each other in the first direction L.

Here, ingress of water between the core wire 51 and the wire connection portion 12 crimped onto the core wire 51 is not preferable. For example, when the metal material of the core wire 51 and the metal material of the wire connection portion 12 have different-sized ionization tendencies, corrosion may occur. As an example, when the material of the wire connection portion 12 is copper, and the material of the core wire 51 is aluminum, the core wire 51 may corrode. The crimping terminal 1 of the present embodiment is provided with the water stop member 20. The water stop member 20 suppresses ingress of water between the wire connection portion 12 and the core wire 51.

For example, the water stop member 20 is a member formed into a sheet mainly containing adhesive such as acrylic adhesive. As the water stop member 20 of the present embodiment, an adhesive sheet being formed of sheet-like nonwoven cloth saturated with adhesive, and having an adhesive effect on the both sides is used.

For example, the water stop member 20 is attached onto the inner wall surface of the flat-plate-shaped wire connection portion 12 illustrated in FIG. 5. As illustrated in FIG. 6, the water stop member 20 is formed into a predetermined shape, and includes a first water stop portion 21, a second water stop portion 22, and a third water stop portion 23. After the completion of crimping, the first water stop portion 21 stops water ingress into an overlapping portion of the first barrel piece portion 15 and the second barrel piece portion 16. More specifically, the first water stop portion 21 forms a water stop region between the barrel piece portions 15 and 16 by being sandwiched between the first barrel piece portion 15 and the second barrel piece portion 16 overlapping each other. The first water stop portion 21 of the present embodiment is disposed in the second barrel piece portion 16, and extends in the first direction L.

The second water stop portion 22 stops water ingress into a portion on the terminal connection portion 11 side from the distal end of the core wire 51. The second water stop portion 22 is disposed at an end portion on the terminal connection portion 11 side of the wire connection portion 12, and extends in the second direction W. At least part of the second water stop portion 22 is desirably provided in a region in which the core wire 51 is placed. For example, the second water stop portion 22 forms a water stop region in a clearance gap between the barrel piece portions 15 and 16 by being sandwiched between the overlapping barrel piece portions 15 and 16. The second water stop portion 22 can also block a clearance gap provided on the terminal connection portion 11 side from the distal end of the core wire 51, by overlapping each other in a crimping process The second water stop portion 22 suppresses ingress of water between the wire connection portion 12 and the core wire 51 from the terminal connection portion 11 side.

The third water stop portion 23 suppresses ingress of water from a clearance gap between the wire connection portion 12 and the covering 52. The third water stop portion 23 is disposed at an end portion on an opposite side of the terminal connection portion 11 side of the wire connection portion 12, and extends in the second direction W. The third water stop portion 23 forms a water stop region between the covering 52 and the wire connection portion 12 by being sandwiched between the covering 52 and the wire connection portion 12.

Through a press process performed on one metal plate serving as a base material, the above-described terminal fitting 10 is processed into a configuration having the flat-plate-shaped wire connection portion 12 illustrated in FIG. 5. In the subsequent attaching process, the water stop member 20 is attached to the flat-plate-shaped wire connection portion 12. After that, in the terminal fitting 10, in a bending process, the terminal connection portion 11 is formed, and the U-shaped wire connection portion 12 is formed.

Figure 7:
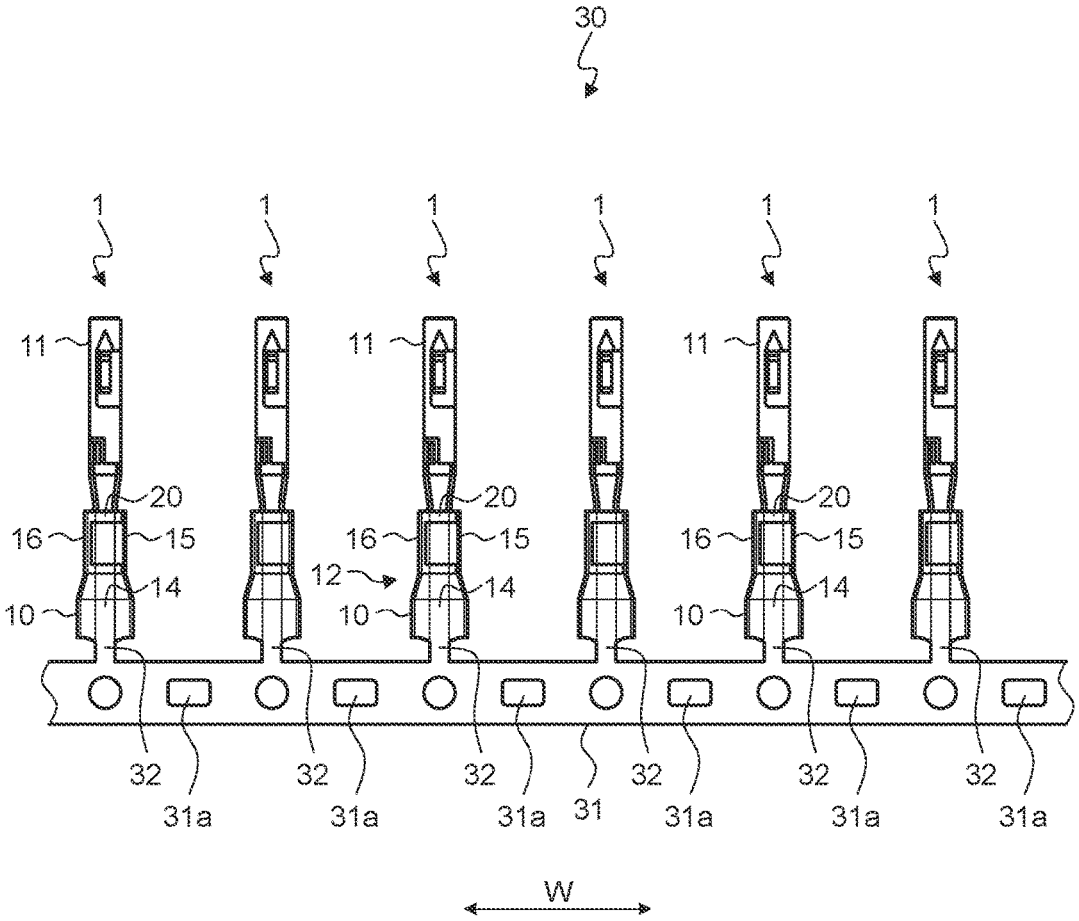
FIG. 7 is a plan view illustrating a terminal chain member according to the embodiment.

In the present embodiment, the terminal chain member 30 illustrated in FIG. 7 is formed through the punching process, the bending process, the attaching process, and the like. The terminal chain member 30 is obtained by chaining a plurality of the crimping terminals 1, and is formed of one metal plate. The terminal chain member 30 is supplied to a terminal crimping apparatus 100. The terminal crimping apparatus 100 executes the crimping process and a terminal cutting process on the terminal chain member 30. The crimping process is a process of swaging and crimping the crimping terminal 1 of the terminal chain member 30 onto the wire 50. The terminal cutting process is a process of cutting off the crimping terminal 1 swaged to the wire 50, from the terminal chain member 30.

The terminal chain member 30 is an aggregate of the crimping terminals 1. The terminal chain member 30 includes a joint piece 31, the plurality of crimping terminals 1, and a plurality of link portions 32. The joint piece 31, the crimping terminals 1, and the link portions 32 are integrally formed of the same base material. In the terminal chain member 30, the crimping terminals 1 are oriented in the same direction, and arranged in parallel at equal intervals. In the terminal chain member 30, one end portions of the respective crimping terminals 1 are linked to each other by the joint piece 31. For example, the shape of the joint piece 31 is a thin and long oblong plate shape. The joint piece 31 extends in the second direction W. The wire connection portions 12 are connected to the joint piece 31 via the link portions 32. More specifically, the link portions 32 link the end portions on the opposite side of the terminal connection portion 11 side of the bottom portions 14 to the joint piece 31.

A plurality of terminal feed holes 31*a* are formed in the joint piece 31. The terminal feed holes 31*a* are arranged at equal intervals in a feed direction of the terminal chain member 30. The terminal feed holes 31*a* are through-holes penetrating through the joint piece 31 in a plate thickness direction. The crimping terminals 1 are positioned by the terminal feed holes 31*a* on a crimping device 102 to be described later. The terminal chain member 30 is set into the terminal crimping apparatus 100 in a state of being winded up in a reel shape.

Figure 8:
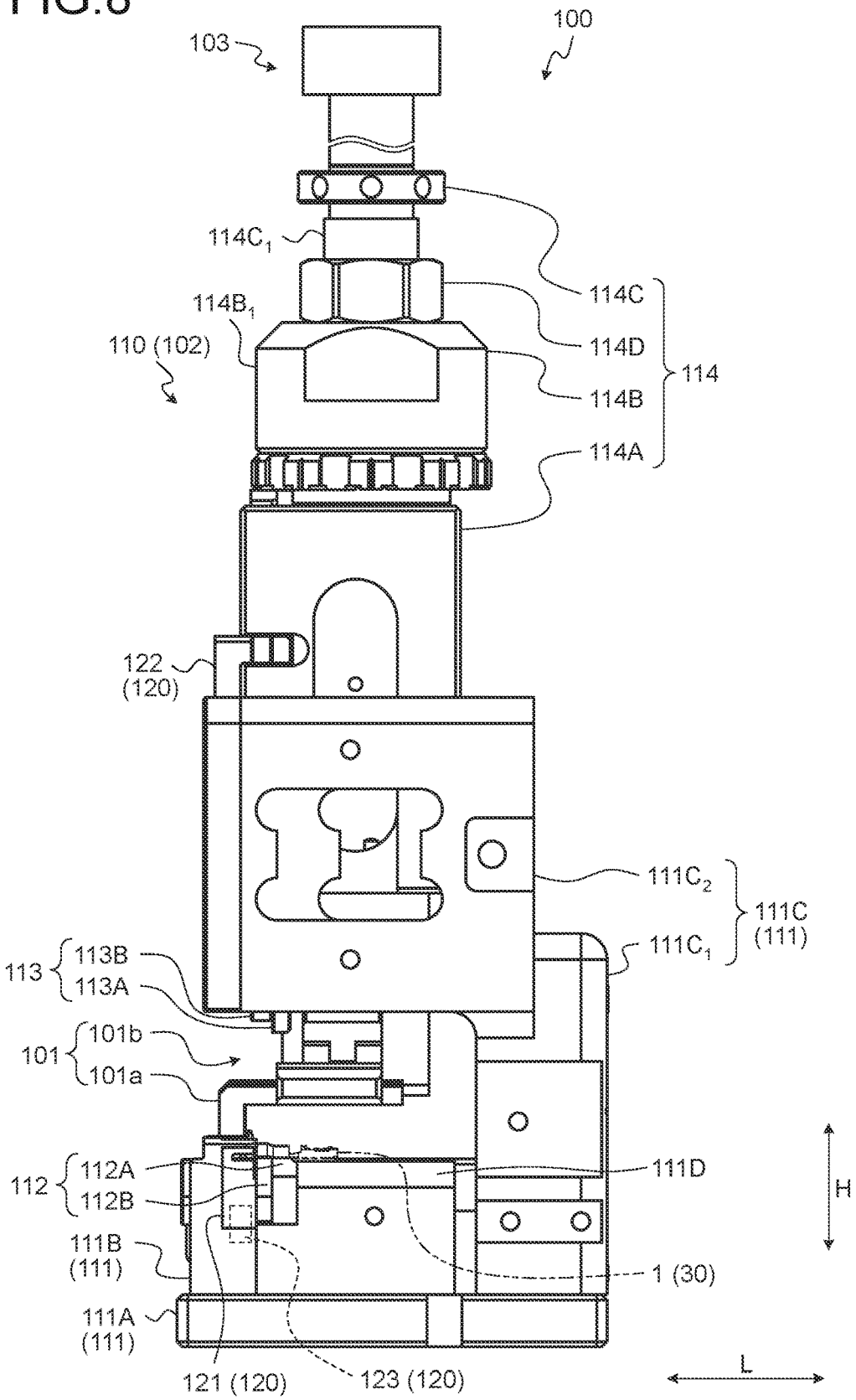
FIG. 8 is a side view of a terminal crimping apparatus according to the embodiment.
Figure 9:
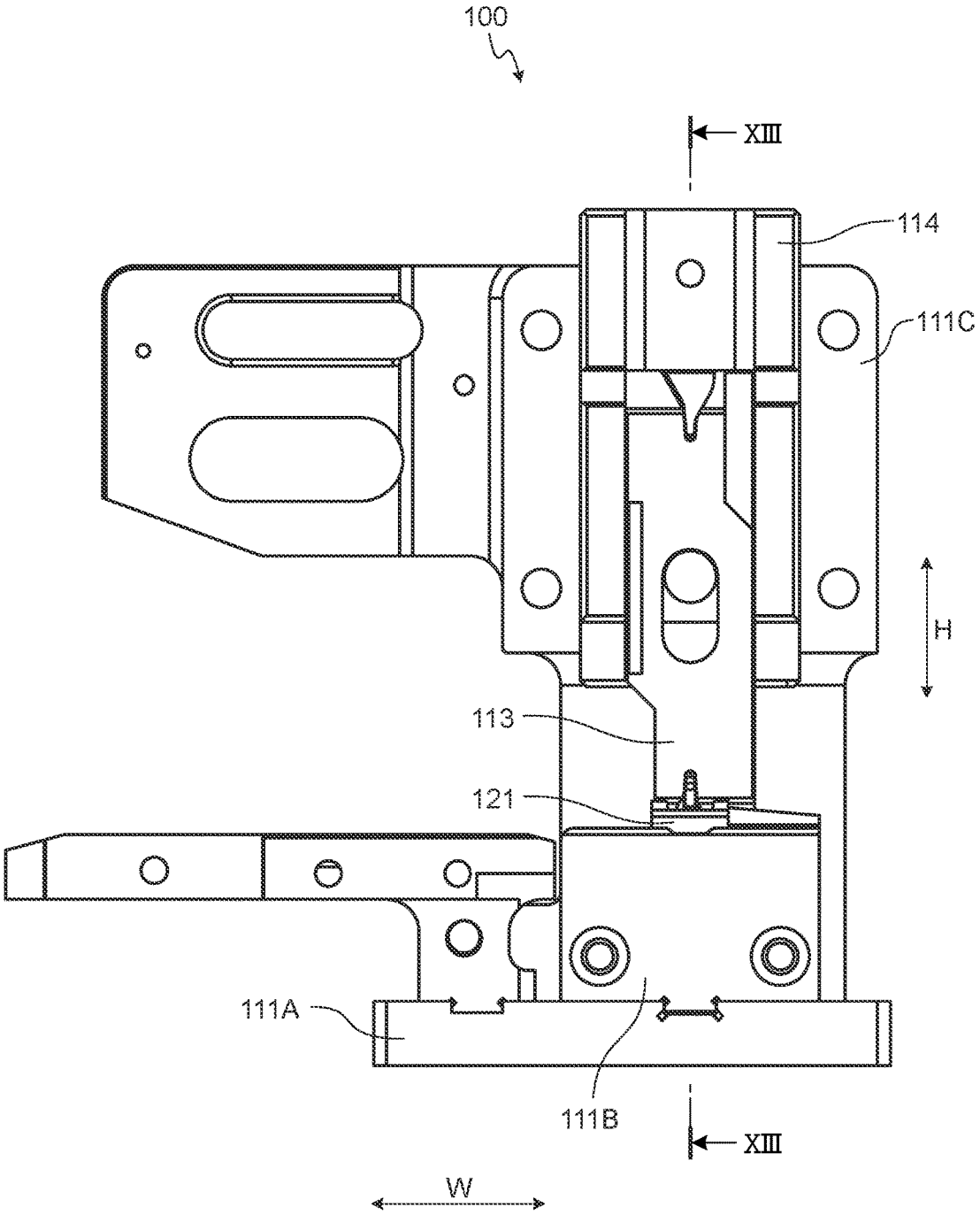
FIG. 9 is a front view of the terminal crimping apparatus according to the embodiment.

As illustrated in FIG. 8, the terminal crimping apparatus 100 includes a terminal supply device 101, the crimping device 102, and a driving device 103. The terminal crimping apparatus 100 is an apparatus referred to as an applicator in this technical field. The terminal supply device 101 is a device that supplies the crimping terminal 1 to a predetermined crimping position. The crimping device 102 is a device that crimps the crimping terminal 1 onto the wire 50 at the predetermined crimping position. The driving device 103 is a device that operates the terminal supply device 101 and the crimping device 102.

The terminal supply device 101 pulls out the terminal chain member 30 winded up in a reel shape, sequentially from the outer peripheral side. The terminal supply device 101 supplies the crimping terminals 1 of the pulled-out terminal chain member 30 to crimping positions, sequentially from the forefront side. When the forefront crimping terminal 1 is crimped onto the wire 50, and cut off from the joint piece 31, the terminal supply device 101 supplies the crimping terminal 1 that newly comes at the forefront, to the crimping position. Each time the crimping process and the terminal cutting process of one crimping terminal 1 are completed, the terminal supply device 101 performs a supply operation to supply the next crimping terminal 1 to the crimping position.

The terminal supply device 101 includes a terminal feed member 101*a* and a power transmission mechanism 101*b*. The terminal feed member 101*a* includes a protruding portion to be inserted into the terminal feed hole 31*a* of the joint piece 31. The terminal feed member 101*a* moves the terminal chain member 30 in the feed direction in a state in which the protruding portion is inserted into the terminal feed hole 31*a*. The power transmission mechanism 101*b* operates the terminal feed member 101*a* in conjunction with a crimping operation performed by the crimping device 102 (up-and-down movement of a ram 114A or the like that is to be described later). The terminal supply device 101 supplies the crimping terminal 1 to the crimping position by moving the terminal feed member 101*a* in the up-down direction and the feed direction in conjunction with the crimping operation of the crimping device 102.

The crimping device 102 executes the crimping process of crimping the supplied crimping terminal 1 onto the wire 50, and a terminal cutting process of cutting off the crimping terminal 1 from the joint piece 31. The crimping device 102 includes a crimping machine 110 and a terminal cutting mechanism 120.

The crimping machine 110 is a device that crimps the crimping terminal 1 onto the wire 50 by swaging the crimping terminal 1 to the end portion of the wire 50. The crimping machine 110 of the present embodiment crimps the crimping terminal 1 onto the wire 50 by swaging the first barrel piece portion 15 and the second barrel piece portion 16 of the crimping terminal 1 so as be winded around the core wire 51 and the covering 52 of the wire 50. The crimping machine 110 includes a frame 111, a first mold 112, a second mold 113, and a power transmission mechanism 114.

The frame 111 includes a base 111A, an anvil supporting member 111B, a transmission portion supporting member 111C, and a support base 111D. The base 111A is a member serving as a basis of the terminal crimping apparatus 100. The base 111A is fixed to a placement base on which the terminal crimping apparatus 100 is to be placed. The anvil supporting member 111B, the transmission portion supporting member 111C, and the support base 111D are fixed onto the base 111A.

The transmission portion supporting member 111C is disposed on the rear side (right side on a paper surface in FIG. 8) and on the upper side (upper side on the paper surface in FIG. 8) of the anvil supporting member 111B. More specifically, the transmission portion supporting member 111C includes a standing portion 111$C_1$ and a ram supporting portion 111$C_2$. The standing portion 111$C_1$ is disposed on the rear side of the anvil supporting member 111B, and is vertically standing upward from the base 111A. The ram supporting portion 111$C_2$ is held on the upper side of the standing portion 111$C_1$. The ram supporting portion 111$C_2$ is a supporting portion that supports the ram 114A to be described later. The ram supporting portion 111$C_2$ is disposed on the upper side of the anvil supporting member 111B, at a predetermined interval from the anvil supporting member 111B. The support base 111D is a base that supports the terminal connection portion 11 of the crimping terminal 1. A height position of the top surface of the support base 111D is a position substantially similar to a height position of the top surface of the first mold 112.

Figure 10:
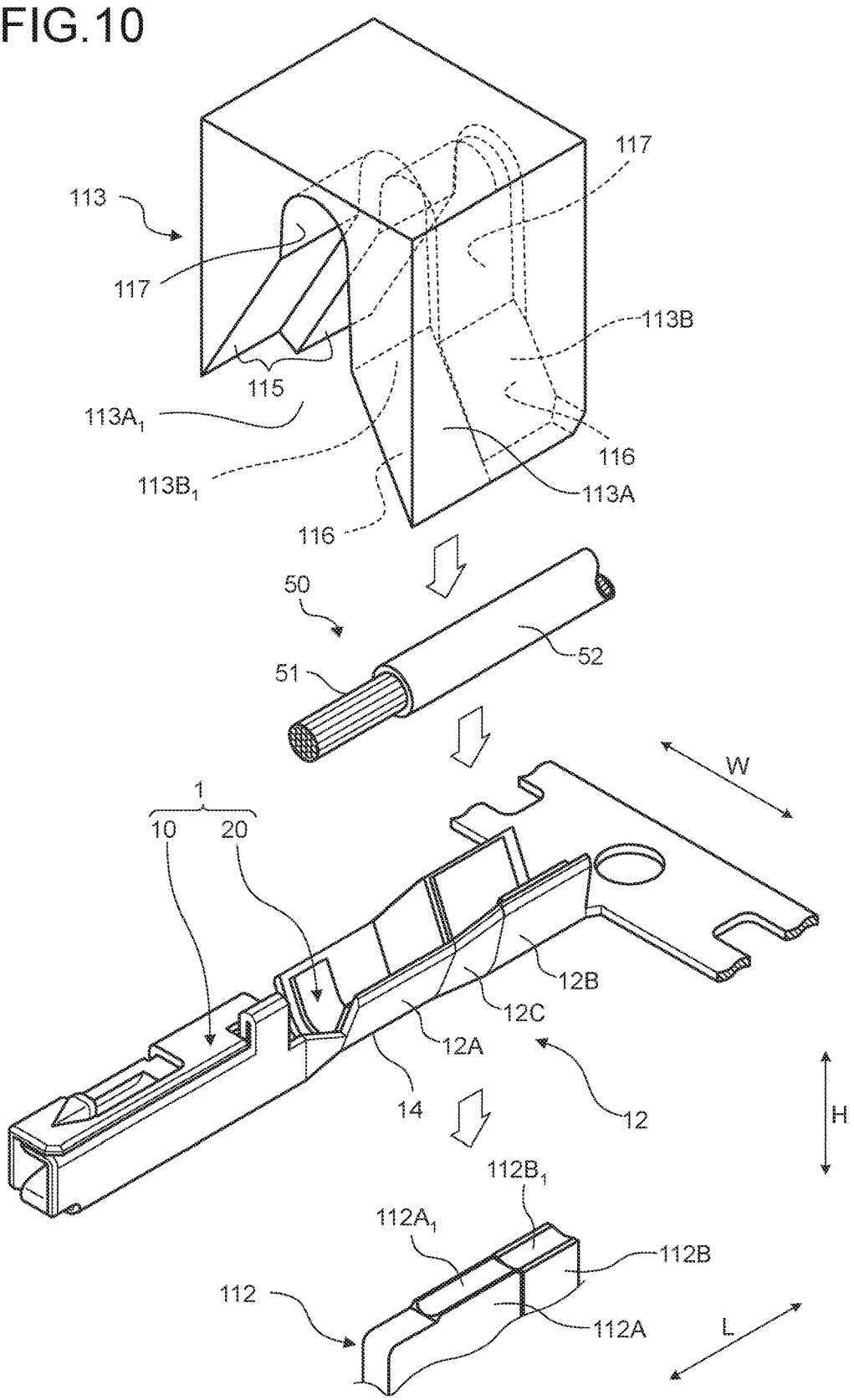
FIG. 10 is a perspective view illustrating first and second molds according to the embodiment.

The first mold 112 and the second mold 113 form a pair. The first mold 112 and the second mold 113 are disposed at an interval in the up-down direction. As illustrated in FIG. 10, the first mold 112 and the second mold 113 crimp the crimping terminal 1 onto the wire 50 by sandwiching the crimping terminal 1 and the wire 50 therebetween. The first mold 112 is a mold that supports the crimping terminal 1 from the lower side. The first mold 112 is formed of two lower molds, and includes a first anvil 112A serving as a first lower mold, and a second anvil 112B serving as a second lower mold. For example, the first anvil 112A and the second anvil 112B are integrally formed. The second mold 113 is disposed on the upper side of the first mold 112. The second mold 113 is formed of two upper molds, and includes a first crimper 113A serving as a first upper mold, and a second crimper 113B serving as a second upper mold.

The first anvil 112A and the first crimper 113A face each other in the up-down direction. The first anvil 112A and the first crimper 113A crimp the core wire crimping portion 12A. More specifically, the first anvil 112A and the first crimper 113A wind the U-shaped core wire crimping portion 12A around the core wire 51 of the wire 50 to crimp the core wire crimping portion 12A onto the core wire 51, by narrowing a distance therebetween.

The second anvil 112B and the second crimper 113B face each other in the up-down direction. The second anvil 112B and the second crimper 113B crimp the covering crimping portion 12B. More specifically, the second anvil 112B and the second crimper 113B wind the U-shaped covering crimping portion 12B around the covering 52 to crimp the covering crimping portion 12B onto the covering 52, by narrowing a distance therebetween.

In the crimping process, by transmitting power to the power transmission mechanism 114, the driving device 103 narrows a distance between the first mold 112 and the second mold 113 to crimp the wire connection portion 12 onto the wire 50. On the other hand, when the crimping process is completed, the driving device 103 widens the distance between the first mold 112 and the second mold 113. In the crimping device 102 of the present embodiment, a distance between the pair of molds 112 and 113 changes by the second mold 113 moving up and down with respect to the first mold 112.

In addition, in the first mold 112, the first anvil 112A and the second anvil 112B may be separately formed, and in the second mold 113, the first crimper 113A and the second crimper 113B may be separately formed. In this case, the driving device 103 and the power transmission mechanism 114 may be configured to separately move the first crimper 113A and the second crimper 113B up and down.

The power transmission mechanism 114 transmits power output from the driving device 103, to the first crimper 113A and the second crimper 113B. As illustrated in FIG. 8, the power transmission mechanism 114 includes the ram 114A, a ram bolt 114B, and a shank 114C.

The ram 114A is a movable member supported so as to be movable up and down with respect to the ram supporting portion 111$C_2$. The second mold 113 is fixed to the ram 114A. Thus, the first crimper 113A and the second crimper 113B move up and down integrally with the ram 114A, with respect to the ram supporting portion 111$C_2$. For example, the shape of the ram 114A is a parallelepiped. A female screw portion (not illustrated) is formed in the ram 114A. The female screw portion is formed on the inner circumferential surface of a hole in the up-down direction that is formed from an inner side of the ram 114A toward an upper end surface.

The ram bolt 114B includes a male screw portion (not illustrated), and the male screw portion is screwed with the female screw portion of the ram 114A. Thus, the ram bolt 114B moves up and down integrally with the ram 114A, with respect to the ram supporting portion 111$C_2$. In addition, the ram bolt 114B includes a bolt head portion 114$B_1$ disposed on the upper side of the male screw portion. A female screw portion (not illustrated) is formed in the bolt head portion 114$B_1$. The female screw portion of the bolt head portion 114$B_1$ is formed on the inner circumferential surface of a hole in the up-down direction that is formed from an inner side of the bolt head portion 114$B_1$ toward an upper end surface.

The shank 114C is a cylindrically-shaped hollow member, and includes a male screw portion 114$C_1$ and a connection portion (not illustrated) at each end portion. The male screw portion 114$C_1$ of the shank 114C is formed on the lower side of the hollow member, and is screwed with the female screw portion of the bolt head portion 114$B_1$ of the ram bolt 114B. Thus, the shank 114C moves up and down integrally with the ram 114A and the ram bolt 114B, with respect to the ram supporting portion 111$C_2$. The connection portion of the shank 114C is connected to the driving device 103.

The driving device 103 includes a driving source (not illustrated), and a power conversion mechanism (not illustrated) that converts drive power of the driving source into power in the up-down direction. The connection portion of the shank 114C is joined to an output shaft of the power conversion mechanism. Thus, the first crimper 113A and the second crimper 113B move up and down integrally with the ram 114A, the ram bolt 114B, and the shank 114C, with respect to the ram supporting portion 111$C_2$, according to an output of the driving device 103 (output of the power conversion mechanism). As the driving source of the driving device 103, an electrical actuator of an electrical motor or the like, a hydraulic actuator of a hydraulic cylinder or the like, an air pressure actuator of an air cylinder or the like, and the like can be applied.

A relative position in the up-down direction of the first crimper 113A with respect to the first anvil 112A, and a relative position in the up-down direction of the second crimper 113B with respect to the second anvil 112B can be changed by adjusting a screw amount of the female screw portion of the bolt head portion 114$B_1$ and the male screw portion 114$C_1$ of the shank 114C. A nut 114D is screwed with the male screw portion 114$C_1$ of the shank 114C on the upper side of the ram bolt 114B. Thus, the nut 114D functions as a so-called locknut together with the female screw portion of the bolt head portion 114$B_1$. By being tightened toward the ram bolt 114B side after the completion of the adjustment of the above-described relative positions, the nut 114D can fix the first crimper 113A and the second crimper 113B at the relative positions.

As illustrated in FIG. 10, recessed surfaces 112$A_1$ and 112$B_1$ recessed downward are formed at the respective upper distal ends of the first anvil 112A and the second anvil 112B. The respective recessed surfaces 112$A_1$ and 112$B_1$ are formed so as to have arc-shaped cross sections, in accordance with the respective shapes of the bottom portion 14 of the U-shaped core wire crimping portion 12A and the U-shaped covering crimping portion 12B. In the crimping machine 110, the recessed surfaces 112$A_1$ and 112$B_1$ each serve as a crimping position. In the crimping terminal 1 supplied with the bottom portion 14 facing downward, the bottom portion 14 of the core wire crimping portion 12A is placed on the recessed surface 112$A_1$ of the first anvil 112A, and the bottom portion 14 of the covering crimping portion 12B is placed on the recessed surface 112$B_1$ of the second anvil 112B. The first mold 112 is supported by the anvil supporting member 111B in a state in which the recessed surfaces 112$A_1$ and 112$B_1$ are exposed upward.

As illustrated in FIG. 10, recessed portions 113$A_1$ and 113$B_1$ recessed upward are respectively formed in the first crimper 113A and the second crimper 113B. The recessed portions 113$A_1$ and 113$B_1$ are disposed to face the respective recessed surfaces 112$A_1$ and 112$B_1$ of the first anvil 112A and the second anvil 112B in the up-down direction. Each of the recessed portions 113$A_1$ and 113$B_1$ includes first and second wall surfaces 115 and 116, and a third wall surface 117. The first wall surface 115 and the second wall surface 116 face each other in the second direction W. The third wall surface 117 links the upper ends of the first and second wall surfaces 115 and 116. While bringing the first to third wall surface 115, 116, and 117 into contact with the first barrel piece portion 15 and the second barrel piece portion 16, each of the recessed portions 113$A_1$ and 113$B_1$ winds the first barrel piece portion 15 and the second barrel piece portion 16 around the end portion of the wire 50 to swage thereonto. Each of the recessed portions 113$A_1$ and 113$B_1$ is formed so as to be able to perform such a swaging operation.

The crimping terminal 1 having been subjected to the crimping processing in the crimping machine 110 is cut off from the joint piece 31 by the terminal cutting mechanism 120. The terminal cutting mechanism 120 cuts the link portion 32 of the crimping terminal 1 supplied to the crimping position by sandwiching the link portion 32 between two terminal cutting portions, and performs the cut off in conjunction with the progress of the crimping process. As illustrated in FIG. 8, the terminal cutting mechanism 120 is disposed on the front side (the left side in on the paper surface in FIG. 8) of the second anvil 112B. The terminal cutting mechanism 120 includes a terminal cutting member 121, a pressing member 122, and an elastic member 123.

Figure 11:
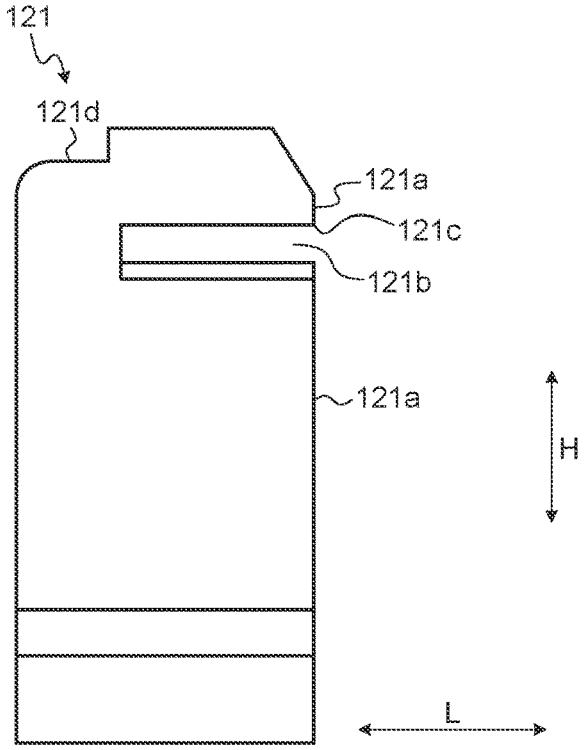
FIG. 11 is a side view illustrating a terminal cutting member according to the embodiment.

The terminal cutting member 121 is formed into a parallelepiped, and is disposed so as to be slidable in the up-down direction along the front surface of the second anvil 112B. As illustrated in FIGS. 11 and 12, a slit 121*b* is formed in the terminal cutting member 121 from a sliding contact surface 121*a* with the second anvil 112B toward the inside. The slit 121*b* is a pathway of the joint piece 31 of the terminal chain member 30. When the crimping target crimping terminal 1 is supplied to the crimping position, part of the link portion 32 linking to the crimping terminal 1 protrudes from the slit 121*b*. The crimping terminal 1 supplied to the crimping position is supported by the first mold 112 from the lower side.

The terminal cutting member 121 cuts the link portion 32 while relatively moving up and down with respect to the first mold 112 and the crimping terminal 1. Here, a position at which the joint piece 31 and the like can be inserted into the slit 121*b* is assumed to be a default position in the up-down direction of the terminal cutting member 121. As illustrated in FIG. 13, an end portion on the wire connection portion 12 side of the link portion 32 protrudes from the slit 121*b* via an opening on the sliding contact surface 121*a* side (i.e., the crimping terminal 1 side) of the slit 121*b*. In the terminal cutting member 121, an edge portion (hereinafter, referred to as an "opening edge".) 121*c* on the upper side in the opening is used as one terminal cutting portion. The other terminal cutting portion is a top surface edge 112*a* of the second anvil 112B.

The pressing member 122 is fixed to the ram 114A, and moves up and down integrally with the ram 114A. The pressing member 122 is disposed on the upper side of the terminal cutting member 121, and presses down the terminal cutting member 121 by lowering. The pressing member 122 is formed into a parallelepiped. The elastic member 123 is a member that adds upper biasing force to the terminal cutting member 121, and is formed of a spring member or the like. The elastic member 123 returns the terminal cutting member 121 to the default position in the up-down direction when pressing force applied from the pressing member 122 is released.

In the terminal cutting mechanism 120, the pressing member 122 lowers together with the lowering of the second mold 113 in the crimping processing, to press down the terminal cutting member 121. By the terminal cutting member 121 lowering, the link portion 32 is sandwiched between the opening edge 121*c* of the slit 121*b* and the top surface edge 112*a* (FIG. 13) of the second anvil 112B. In the terminal cutting mechanism 120, the opening edge 121*c* and the top surface edge 112*a* function as scissors, and add shearing force to the link portion 32. By the terminal cutting member 121 being further pressed down, the opening edge 121*c* and the top surface edge 112*a* cut the link portion 32, and cut off the crimping terminal 1 from the joint piece 31. In addition, for enhancing cutting performance, the opening edge 121*c* is inclined on the sliding contact surface 121*a* with respect to the top surface edge 112*a*.

As illustrated in FIG. 13, the crimping target wire 50 is disposed at a predetermined position located between the terminal cutting member 121 and the pressing member 122. More specifically, the wire 50 is placed on a top surface 121*d* of the terminal cutting member 121. Thus, a space for letting the wire 50 escape is provided in at least one of an upper portion of the terminal cutting member 121 and a lower portion of the pressing member 122 so that the wire 50 is not squished therebetween.

Here, the predetermined position is a position at which the end portion of the wire 50 not having been subjected to the crimping processing exists on the upper side of the bottom portion 14 of the flat-plate-shaped wire connection portion 12. In addition, the predetermined position is a position at which the core wire 51 can be placed on the bottom portion 14 of the core wire crimping portion 12A so that the distal end of the core wire 51 that has been pressed down at the start of the crimping processing does not protrude from the core wire crimping portion 12A. The core wire 51 extends in an axis line direction in accordance with the crimping processing, and a distal end position of the core wire 51 sometimes moves in the axis line direction. The predetermined position is desirably determined in consideration of the extension.

On the other hand, the end portion (the core wire 51 at the distal end and the covering 52) of the wire 50 is pressed down by the second mold 113 toward the inner wall surface side of the wire connection portion 12. Thus, if no holding is provided, the wire 50 is uplifted from the top surface 121*d* of the terminal cutting member 121, and the core wire 51 at the distal end and the covering 52 may be crimped in a state of not being placed on the bottom portion 14 of the wire connection portion 12. Thus, the terminal crimping apparatus 100 of the present embodiment is provided with a wire holding mechanism that holds the wire 50 at the predetermined position between itself and the upper portion of the terminal cutting member 121, and suppresses a position shift of the end portion of the wire 50 with respect to the wire connection portion 12 that occurs in the crimping processing.

The wire holding mechanism includes a wire retaining member 118 (FIG. 13) that retains the wire 50 placed on the top surface 121*d* of the terminal cutting member 121 that serves as a wire placement portion, by pressing the wire 50 against the top surface 121*d*. The wire retaining member 118 is disposed on the upper side of the terminal cutting member 121, and between the second mold 113 and the pressing member 122. A space (hereinafter, referred to as a "wire holding space".) 118A for holding the covering 52 of the wire 50 is formed between the top surface 121*d* of the terminal cutting member 121 and the bottom surface of the wire retaining member 118. The wire holding space 118A suppresses the uplift of the wire 50 from the top surface 121*d* of the terminal cutting member 121 that occurs in the crimping process, and suppresses a position shift of the core wire 51 at the distal end and the covering 52 with respect to the wire connection portion 12. The wire retaining member 118 is a member that can move up and down with respect to the top surface 121*d* of the terminal cutting member 121, and forms the wire holding space 118A between itself and the upper portion of the terminal cutting member 121 by lowering. For example, the wire retaining member 118 is fixed to the ram 114A, and moves up and down integrally with the ram 114A. The wire 50 is held in the wire holding space 118A formed in accordance with the lowering of the wire retaining member 118.

For example, the crimping terminal 1 according to the present embodiment is crimped onto the wire 50 by the following terminal crimping apparatus 100. In the crimping terminal 1, water stop of the wire connection portion 12 is performed by the water stop member 20. If the water stop member 20 fails to be surely attached to the wire connection portion 12, the water stop member 20 may be detached from the wire connection portion 12 in the crimping process, and water stop performance may thereby decrease.

As described below, in a method of manufacturing a crimping terminal of the present embodiment, the water stop member 20 is attached to the wire connection portion 12 not having been subjected to the bending processing. This can enhance positional accuracy in attaching the water stop member 20 to the wire connection portion 12, and attach the water stop member 20 to the wire connection portion 12 with equal pressure.

Punching Process

Figure 14:
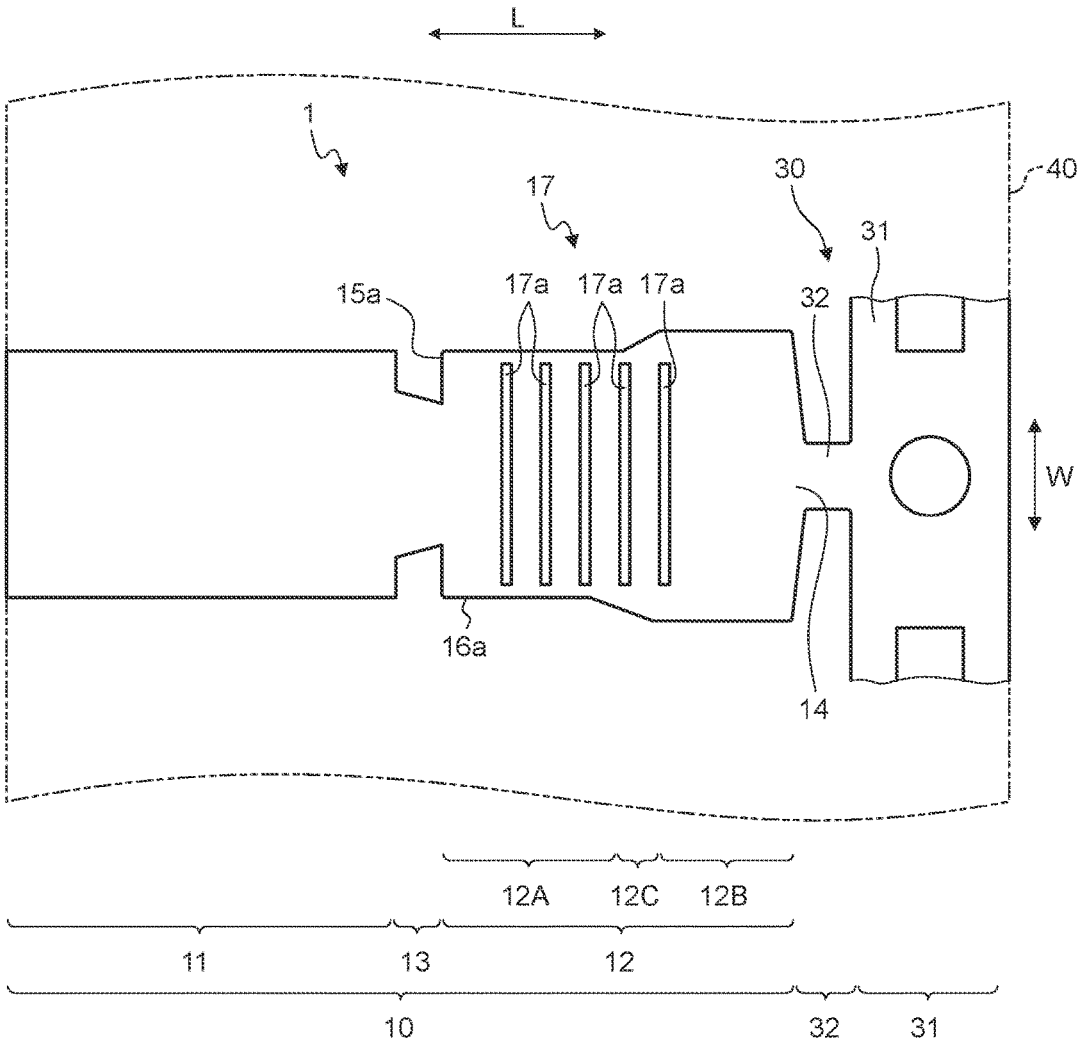
FIG. 14 is a plan view illustrating the crimping terminal according to the embodiment that is obtainable after a punching process.

The method of manufacturing a crimping terminal of the present embodiment will be described in detail with reference to FIGS. 14 to 18. First, as illustrated in FIG. 14, the flat-plate-shaped crimping terminal 1 is formed in the punching process. More specifically, in the punching process of the present embodiment, the terminal chain member 30 including a plurality of crimping terminals 1 is punched out from a flat-plate-shaped metal base material 40. In the punching process, a residual portion is removed from the base material 40 so as to integrally leave the crimping terminal 1, the joint piece 31, and the link portion 32, and the terminal chain member 30 is formed. At a time point at which the punching process is completed, the crimping terminal 1 has a flat plate shape. Thus, the terminal connection portion 11, the wire connection portion 12, and the joint portion 13 form an integrated flat-plate-shaped component. In addition, the recessed portions 17*a* may be formed in the punching process, or may be formed after the punching process.

Terminal Connection Portion Shaping Process

The terminal connection portion shaping process is executed after the punching process. In the terminal connection portion shaping process, the bending processing of the terminal connection portion 11 is performed. In the terminal connection portion shaping process, the terminal connection portion 11 is molded into a tubular shape as illustrated in FIG. 5.

Attaching Process

The attaching process is executed after the punching process, and for example, executed after the terminal connection portion shaping process. In the attaching process, as illustrated in FIG. 6, the water stop member 20 is attached to the wire connection portion 12. The water stop member 20 is formed into the predetermined shape prior to the attaching process. For example, the water stop member 20 is cut out into the predetermined shape by a Thomson blade. The predetermined shape of the present embodiment is a U-shape. The water stop member 20 having the predetermined shape includes the band-like first water stop portion 21, the band-like second water stop portion 22 connecting to one end of the first water stop portion 21, and the band-like third water stop portion 23 connecting to the other end of the first water stop portion 21. The second water stop portion 22 and the third water stop portion 23 each extend in a direction perpendicular to the longitudinal direction of the first water stop portion 21.

The both surfaces of the water stop member 20 formed into the predetermined shape are each covered with release coated paper. After the release coated paper on the surface to be attached to the wire connection portion 12 is peeled off, the water stop member 20 is attached to the wire connection portion 12. The attaching process may be manually performed by an operator, or automatically performed by a machine.

The first water stop portion 21 is attached to a rim portion of the wire connection portion 12 that extends in the longitudinal direction. In the present embodiment, the rim portion extending in the longitudinal direction is a rim portion corresponding to the distal end 16*a* of the second barrel piece portion 16. The first water stop portion 21 is attached to the distal end 16*a* so as to extend in the first direction L.

The second water stop portion 22 and the third water stop portion 23 are attached to rim portions at both ends in the longitudinal direction of the wire connection portion 12. The second water stop portion 22 is attached to the rim portion at an end portion on the terminal connection portion 11 side of the wire connection portion 12. The third water stop portion 23 is attached to the rim portion at an end portion on an opposite side of the terminal connection portion 11 of the wire connection portion 12. The second water stop portion 22 and the third water stop portion 23 are attached so as to extend from the first water stop portion 21 in the second direction W.

Bending Process

The bending process is executed after the attaching process. In the bending process, the wire connection portion 12 to which the water stop member 20 is attached is bent. The bending process is included in the wire connection portion shaping process. The wire connection portion shaping process may include a serration formation process of forming the serration region 17, in addition to the bending process. In this case, the serration formation process is preferably executed before the attaching process and the bending process.

Figure 15:
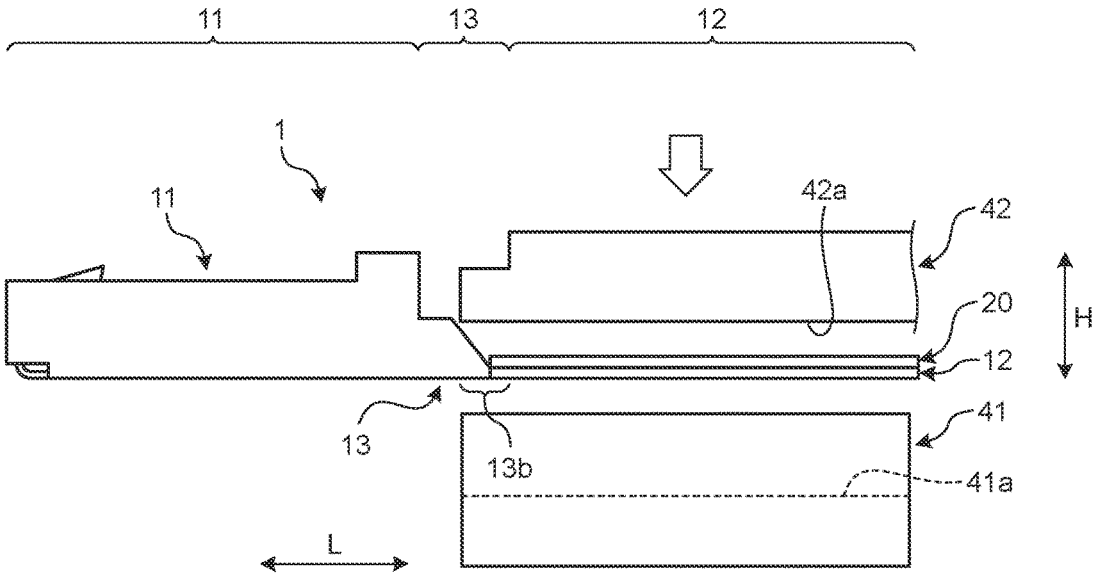
FIG. 15 is a side view illustrating a bending process of the embodiment.

In the bending process of the present embodiment, the bending processing is performed on the wire connection portion 12 so that a cross-sectional shape becomes a U-shape as illustrated in FIG. 1, and the like. In the bending process, as illustrated in FIG. 15, the bending processing is performed using a die 41 and a punch 42. The die 41 is a member supporting the crimping terminal 1. In the die 41, a surface supporting the crimping terminal 1 is a recessed surface 41*a*. The recessed surface 41*a* is a surface having a U-shaped cross section, and is a surface having a shape corresponding to the cross-sectional shape of the wire connection portion 12 having been subjected to the bending processing.

The punch 42 sandwiches the crimping terminal 1 between itself and the die 41, and bends the crimping terminal 1 to deform. The punch 42 includes a pressing surface 42*a* that presses the crimping terminal 1. The pressing surface 42*a* is a protruding surface having a U-shaped cross section, and is a surface having a shape corresponding to the cross-sectional shape of the wire connection portion 12 having been subjected to the bending processing.

The flat-plate-shaped wire connection portion 12 to which the water stop member 20 is attached is placed on the die 41. The punch 42 moves toward the die 41 on which the wire connection portion 12 is placed, and performs the bending processing of the wire connection portion 12 by sandwiching the wire connection portion 12 between itself and the die 41. The punch 42 may be formed so that a difference between pressing force to be applied to a region in the wire connection portion 12 in which the water stop member 20 is attached, and pressing force to be applied to a region in which the water stop member 20 is attached does not become too large.

In addition, flowing of the water stop member 20 in the bending process is difficult to occur due to the follow-up property of the adhesive. Here, the flowing refers to a phenomenon in which a position of the water stop member 20 shifts from a position at which the water stop member 20 has been attached in the attaching process. The water stop member 20 of the present embodiment has a follow-up property to such a degree that the deformation of the wire connection portion 12 in the bending process can be followed. In other words, the adhesive of the water stop member 20 has a physicality that can deform in accordance with the bending deformation of the wire connection portion 12. The deformation of the adhesive is elastic deformation, plastic deformation, viscous deformation, or a deformation of a combination of these. Thus, each region of the water stop member 20 can perform deformation such as bending and extension in accordance with the deformation of the wire connection portion 12. In addition, when the water stop member 20 is pressed in the bending process, the water stop member 20 elastically deforms in a thickness direction to be compressed. If the pressing force is released, the thickness returns to the original thickness. Thus, the bending process can be executed without deteriorating the function of the water stop member 20.

In this manner, the method of manufacturing a crimping terminal of the present embodiment includes the punching process, the attaching process, and the bending process. The punching process is a process of punching out the crimping terminal 1 from the flat-plate-shaped metal base material 40. In the attaching process, the water stop member 20 being a sheet-like adhesive is attached to the wire connection portion 12. In the bending process, the wire connection portion 12 to which the water stop member 20 is attached is bent. According to the method of manufacturing a crimping terminal of the present embodiment, the water stop member 20 can be stably attached to the wire connection portion 12. For example, a variation in an attaching position of the water stop member 20 with respect to the wire connection portion 12 is suppressed. In addition, a variation in pressing force of the water stop member 20 with respect to the wire connection portion 12 is suppressed. Thus, the crimping terminal 1 manufactured by the method of manufacturing a crimping terminal of the present embodiment can offer stable water stop performance.

In addition, in the method of manufacturing a crimping terminal of the present embodiment, in the attaching process, the water stop member 20 is attached to the rim portion in the wire connection portion 12 that extends in the first direction L, and the rim portions at the both ends in the first direction L. The shape of the water stop member 20 to be attached is a U-shape. When the water stop member 20 having such a complicated shape is to be attached, if the attachment target wire connection portion 12 is curved into a U-shape, it is difficult to appropriately attach. In the method of manufacturing a crimping terminal of the present embodiment, the attachment target wire connection portion 12 has a flat plate shape. Thus, the water stop member 20 can be attached easily and appropriately.

In addition, in the method of manufacturing a crimping terminal of the present embodiment, as will be described below, in the bending process, the bending processing of the wire connection portion 12 and the bending processing of the joint portion 13 are performed concurrently. This suppresses the swelling of the joint portion 13.

As illustrated in FIG. 15, the die 41 and the punch 42 of the present embodiment are configured to be able to concurrently perform bending processing of at least part of the joint portion 13 and the wire connection portion 12. A total length of the die 41 and the punch 42 is longer than a total length of the wire connection portion 12. Thus, in addition to the wire connection portion 12, at least part of the joint portion 13 can be placed on the die 41. In addition, the punch 42 can concurrently sandwich the wire connection portion 12 and the joint portion 13 between itself and the die 41, and concurrently perform the bending processing of the wire connection portion 12 and the joint portion 13. For example, the die 41 and the punch 42 of the present embodiment bend a portion 13*b* provided on the wire connection portion 12 side from an intermediate portion in the first direction L of the joint portion 13, together with the wire connection portion 12, into a U-shape.

Figure 16:
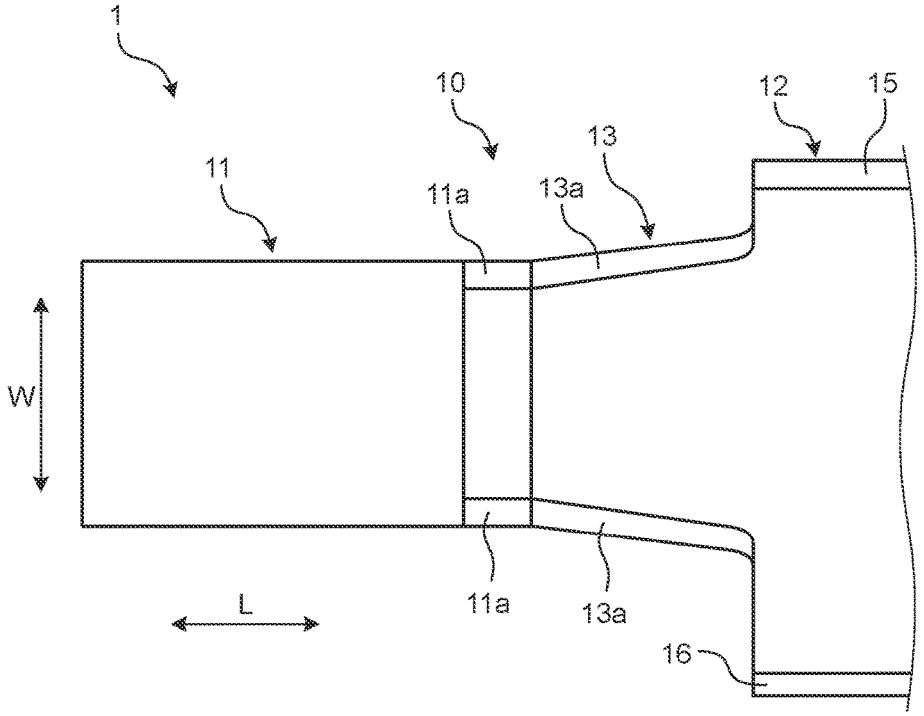
FIG. 16 is a plan view illustrating the crimping terminal according to the embodiment that is obtainable after bending processing.
Figure 17:
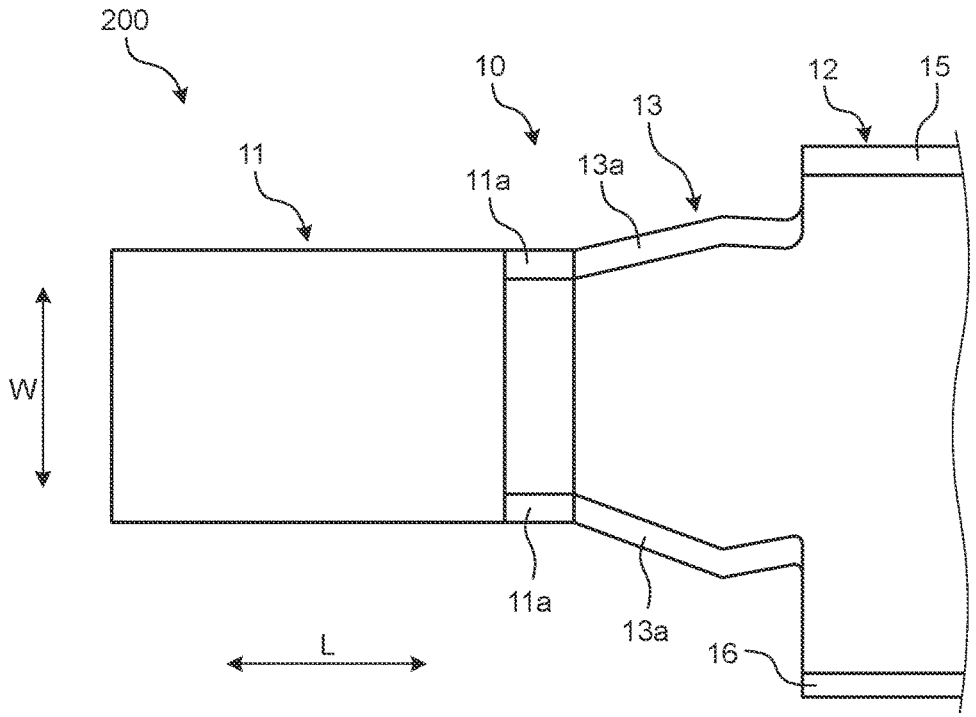
FIG. 17 is a plan view illustrating a crimping terminal according to a comparative example that is obtainable after bending processing.

According to the method of manufacturing a crimping terminal of the present embodiment, in the bending process, the wire connection portion 12 and the joint portion 13 are concurrently bent by one process. Thus, as illustrated in FIG. 16, the swelling is difficult to occur in the joint portion 13 having been subjected to the bending processing. FIG. 16 is a plan view illustrating the crimping terminal according to the embodiment that is obtainable after the bending processing, and FIG. 17 is a plan view illustrating a crimping terminal according to a comparative example that is obtainable after the bending processing. In a crimping terminal 200 of the comparative example, in the bending process of bending the wire connection portion 12, the bending processing is not performed on the joint portion 13. In the crimping terminal 200 according to the comparative example, the side walls 13*a* of the joint portion 13 swell outward in the width direction. If the side walls 13*a* swell outward in this manner, in the crimping process, the joint portion 13 may interfere with the crimping device 102, and the joint portion 13 may be damaged. In addition, a wind amount of the barrel piece portions 15 and 16 in the crimping process is reduced, and sealability and electrical performance may be affected.

In contrast to this, in the crimping terminal 1 manufactured by the method of manufacturing a crimping terminal of the present embodiment, as illustrated in FIG. 16, the side walls 13*a* of the joint portion 13 are difficult to swell outward. Because the bending processing of the wire connection portion 12 and the joint portion 13 is integrally performed, a curve portion and a bent portion are difficult to be generated between the wire connection portion 12 and the terminal connection portion 11 on the side walls 13*a*. In addition, because the outer wall surfaces of the side walls 13*a* are supported by the die 41, the side walls 13*a* are difficult to swell outward. Thus, according to the crimping terminal 1 manufactured by the method of manufacturing a crimping terminal of the present embodiment, a wind amount of the barrel piece portions 15 and 16 increases in the crimping, and sealability and electrical performance in the wire connection portion 12 enhance. In addition, because swelling is difficult to occur on the side walls 13*a*, interference with the crimping device 102 in the crimping process is suppressed before happens.

A method of manufacturing a wire-provided crimping terminal of the present embodiment will be described. The method of manufacturing a wire-provided crimping terminal is a method of manufacturing crimping the wire connection portion 12 of the crimping terminal 1 onto the wire 50, and manufacturing the wire 50 to which the crimping terminal 1 is crimped. The method of manufacturing a wire-provided crimping terminal includes the wire installation process, the crimping process, and the terminal cutting process.

Wire Installation Process

The wire installation process is a process of installing the wire 50 in the wire connection portion 12 to be crimped by the crimping device 102. In other words, the wire installation process is a process of installing the wire 50 in the wire connection portion 12 of the crimping terminal 1 supplied to the crimping position. For example, the wire installation process is performed by the terminal crimping apparatus 100. The terminal crimping apparatus 100 of the present embodiment includes a wire supply device that supplies the wire 50 to the crimping terminal 1 at the crimping position. The wire supply device sets the wire 50 at a predetermined position in the wire connection portion 12.

Figure 18:
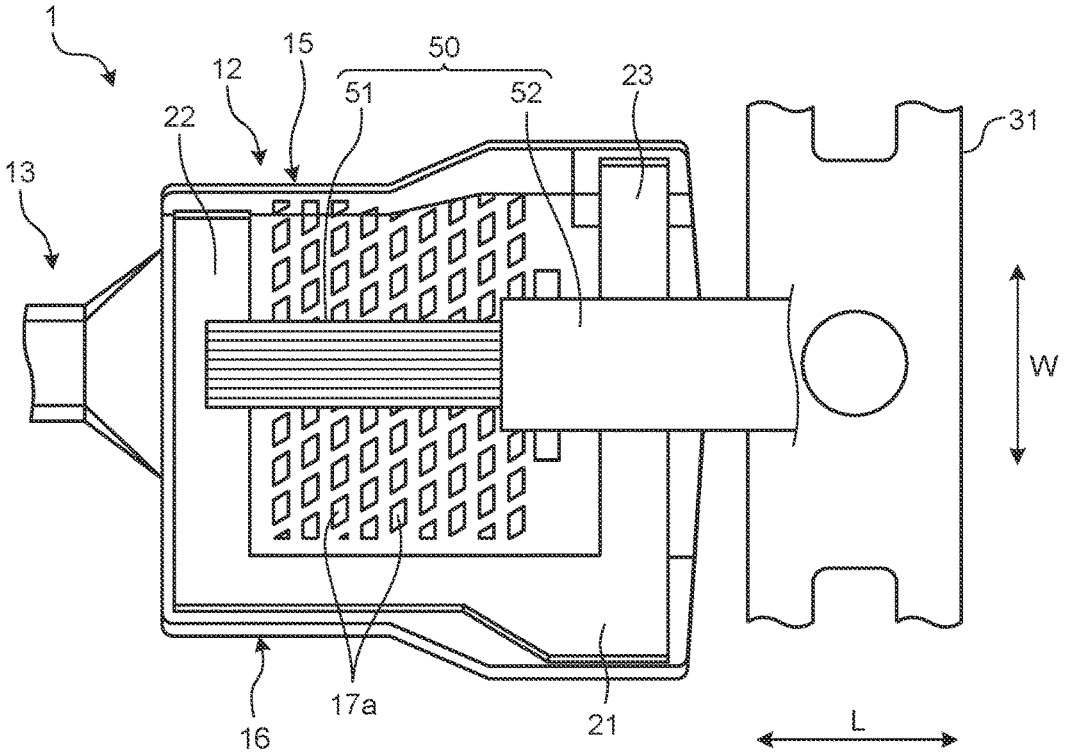
FIG. 18 is a plan view illustrating a wire installation process according to the embodiment.

In the wire installation process of the present embodiment, the wire supply device installs the wire 50 so that the core wire 51 is in contact with the water stop member 20. As illustrated in FIG. 18, the wire 50 is installed so that the distal end of the core wire 51 comes into contact with the second water stop portion 22. The core wire 51 comes into contact with the second water stop portion 22 at a position on the bottom portion of the wire connection portion 12 formed into the U-shape. The distal end of the core wire 51 is placed on the second water stop portion 22 so as not to protrude toward the joint portion 13 side more than the second water stop portion 22. For example, the distal end of the core wire 51 is placed at a center portion in the first direction L of the second water stop portion 22. The second water stop portion 22 adheres to the core wire 51 to suppress the uplift and a movement of the core wire 51.

Crimping Process

The crimping process is executed after the wire installation process. Because the core wire 51 is brought into a state of being in contact with the water stop member 20 in the wire installation process, the movement of the wire 50 and the generation of the fray of the core wire 51 in the crimping process are suppressed. For example, a relative movement of the core wire 51 with respect to the wire connection portion 12 is suppressed by adhesive force of the water stop member 20. When the wire connection portion 12 is crimped onto the wire 50, the core wire 51 tries to extend in the first direction L according to pressing force for crimping. At this time, the water stop member 20 suppresses a movement in the first direction L of the core wire 51. In other words, a relative movement of the distal end of the core wire 51 with respect to the wire connection portion 12 is suppressed. By the movement of the distal end of the core wire 51 being suppressed, as will be described below, exposure of the core wire 51 from the crimped wire connection portion 12 is suppressed. In addition, the terminal cutting process is performed after the crimping process or concurrently with the crimping process.

Figure 19:
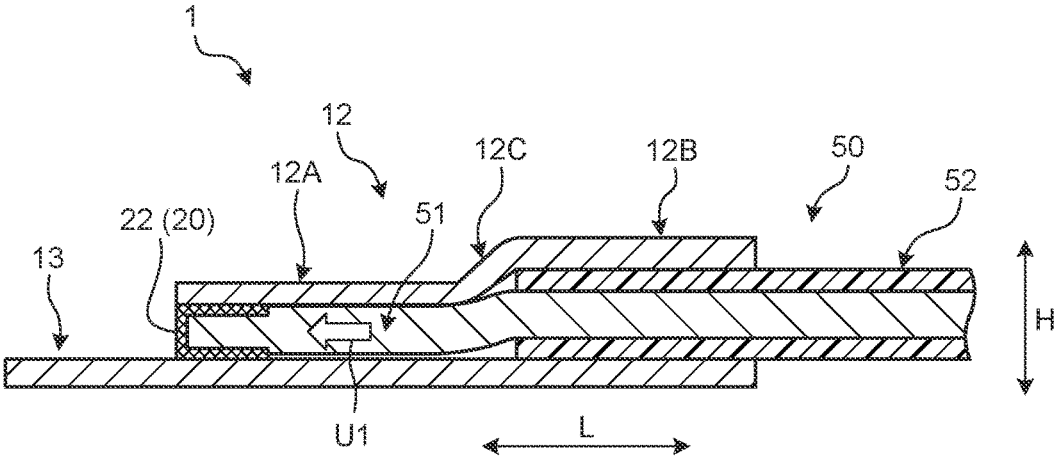
FIG. 19 is a cross-sectional view illustrating the crimping terminal according to the embodiment that is obtainable after crimping.

FIG. 19 illustrates a cross section obtainable after the crimping according to the present embodiment is completed. Because the water stop member 20 adheres to the core wire 51, friction between the water stop member 20 and the core wire 51 is static friction at the start of the crimping process. Thus, if force in an extending direction is generated in the core wire 51 in the crimping process, a movement amount U1 of the core wire 51 traveling toward the joint portion 13 side is reduced. As a result, exposure of the core wire 51 and the water stop member 20 to the outside from the wire connection portion 12 is suppressed. As illustrated in FIG. 19, the water stop member 20 covers the distal end of the core wire 51, and seals between the core wire crimping portion 12A and the core wire 51. This appropriately suppresses ingress of water between the core wire 51 and the core wire crimping portion 12A. In addition, the water stop member 20 may slightly protrude from the core wire crimping portion 12A while covering the distal end of the core wire 51.

Figure 20:
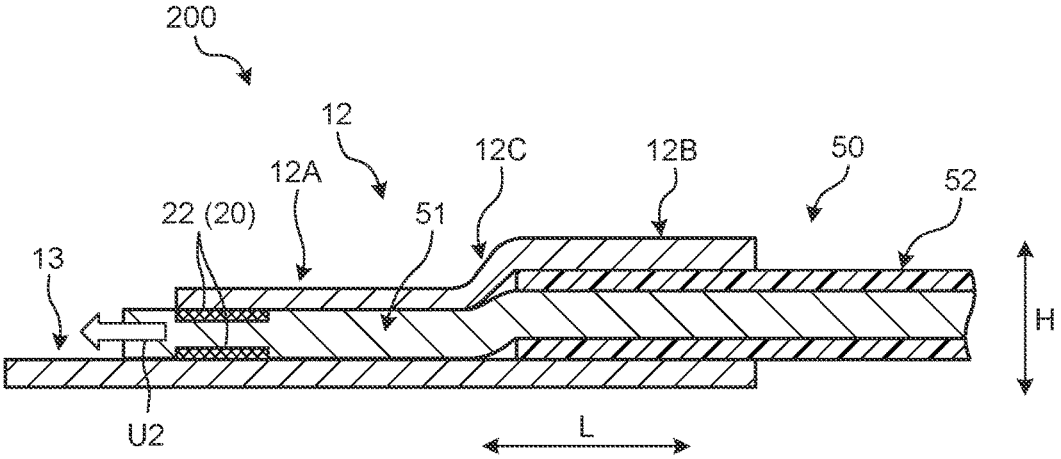
FIG. 20 is a cross-sectional view illustrating a crimping terminal according to a comparative example that is obtainable after crimping.

FIG. 20 illustrates a cross section obtainable after crimping according to a comparative example is completed. In a method of manufacturing a wire-provided crimping terminal of the comparative example, in the wire installation process, the core wire 51 is not brought into contact with the water stop member 20. In other words, the crimping process is started in a state in which the core wire 51 is not in contact with the water stop member 20. In this case, even if the core wire 51 comes into contact with the water stop member 20 in the crimping process, contact between the water stop member 20 and the core wire 51 is dynamic friction. In addition, when the core wire 51 comes into contact with the water stop member 20, in some cases, the core wire 51 has already started to extend. As a result, a movement amount U2 of the core wire 51 traveling toward the joint portion 13 side easily becomes large, and the core wire 51 sometimes protrudes from wire connection portion 12 toward the joint portion 13 side. In addition, the water stop member 20 cannot cover the distal end of the core wire 51, and as illustrated in FIG. 20, the distal end of the core wire 51 is sometimes exposed.

Figure 21:
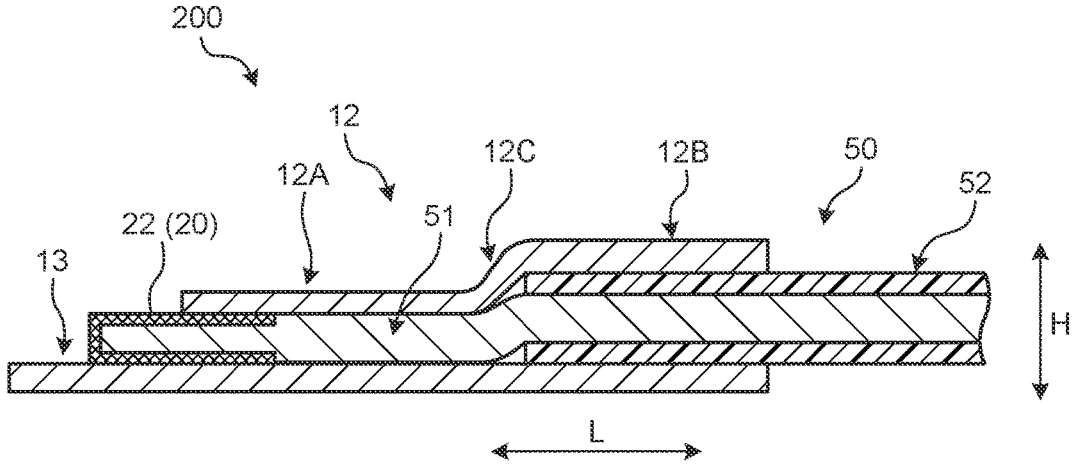
FIG. 21 is a cross-sectional view illustrating a crimping terminal according to another comparative example that is obtainable after crimping.

FIG. 21 illustrates a cross section of a crimping terminal obtainable after crimping according to another comparative example is completed. In the crimping terminal 200 of the comparative example illustrated in FIG. 21, although the water stop member 20 covers the distal end of the core wire 51, the water stop member 20 largely protrudes from the wire connection portion 12. If a protrusion amount of the water stop member 20 is too much, decreases in sealability and electrical performance are sometimes caused. In addition, the protruding water stop member 20 may affect the adjacent terminal connection portion 11. In view of this, in the crimping terminal 1 according to the present embodiment, the water stop member 20 adhering to the core wire 51 suppresses the extension of the core wire 51. Thus, even if the water stop member 20 protrudes from the wire connection portion 12 due to the crimping, the protrusion amount is reduced. Thus, a decrease in performance such as water stop performance in the crimping terminal 1 is suppressed.

The execution of the wire installation process of the present embodiment reduces the movement amount U1 of the core wire 51, and reduces a variation in the movement amount U1. In other words, a variation in a relative position of the wire 50 with respect to the crimped wire connection portion 12 is reduced. Thus, according to the method of manufacturing a wire-provided crimping terminal of the present embodiment, sealability and electrical performance of the crimping terminal 1 can be enhanced.

In addition, the material of the core wire 51 of the wire 50 is not limited to aluminum. For example, the core wire 51 may be copper or copper alloy, or another conductive metal. The material of the crimping terminal 1 is not limited to copper and copper alloy, and may be another conductive metal.

First Modified Example of Embodiment

Figure 22:
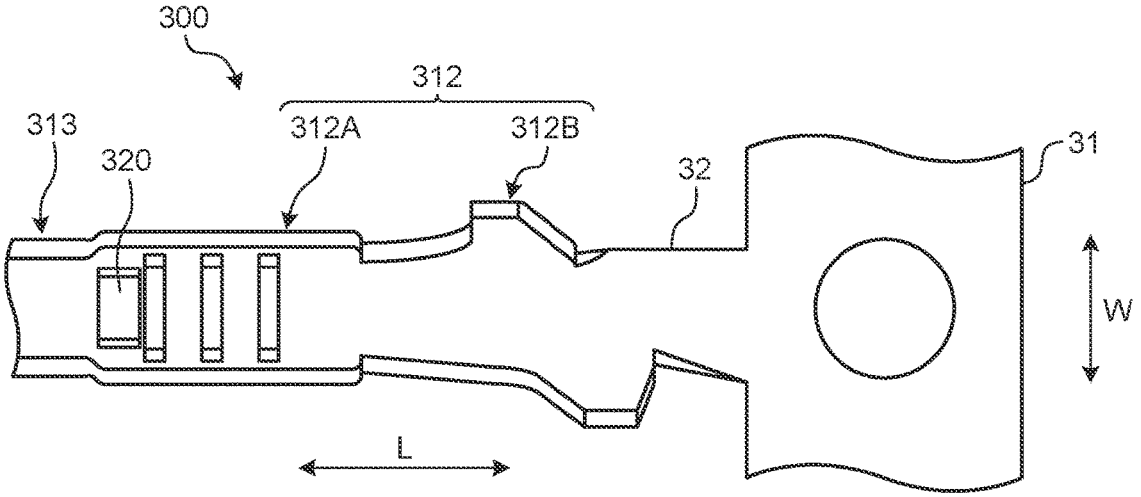
FIG. 22 is a plan view of a crimping terminal according to a first modified example of the embodiment.
Figure 23:
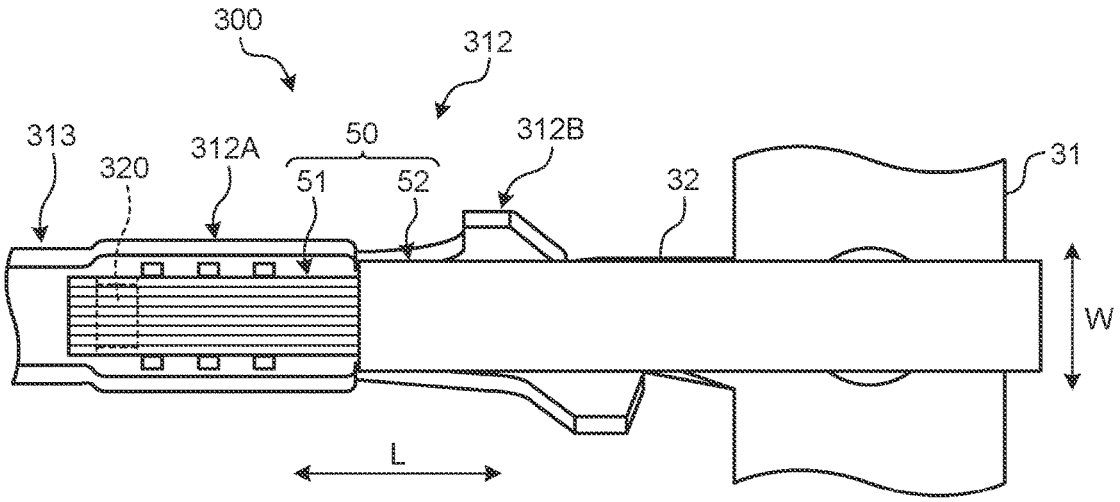
FIG. 23 is a plan view illustrating a wire installation process according to the first modified example of the embodiment.
Figure 24:
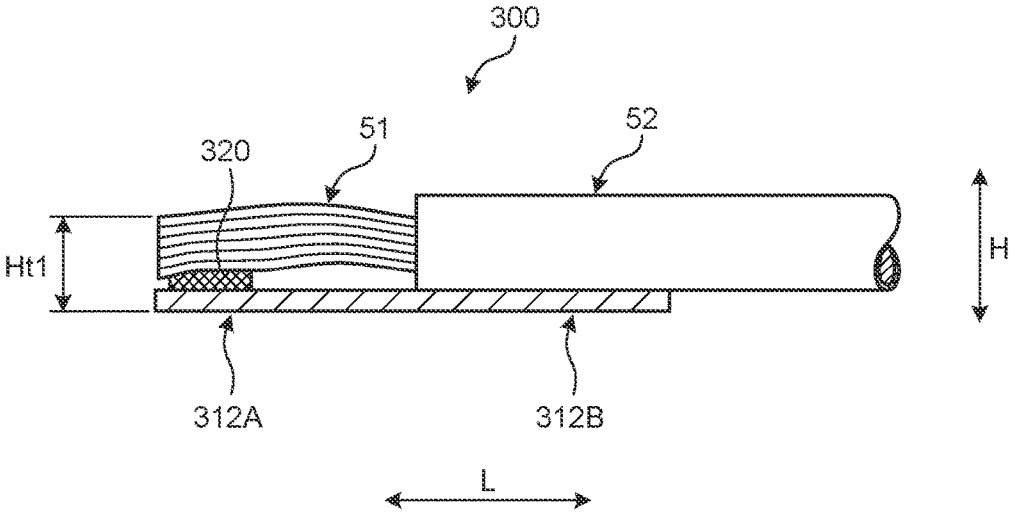
FIG. 24 is a side view illustrating the crimping terminal according to the first modified example of the embodiment that is obtainable after crimping.
Figure 25:
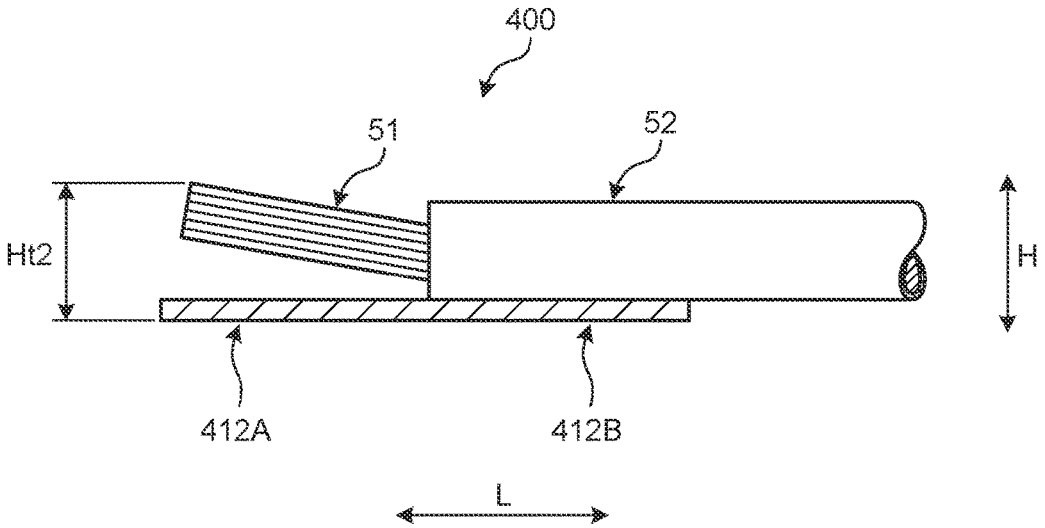
FIG. 25 is a side view illustrating a crimping terminal according to a comparative example that is obtainable after crimping.

A first modified example of the embodiment will be described. FIG. 22 is a plan view of a crimping terminal according to the first modified example of the embodiment, FIG. 23 is a plan view illustrating a wire installation process according to the first modified example of the embodiment, FIG. 24 is a side view illustrating the crimping terminal according to the first modified example of the embodiment that is obtainable after crimping, and FIG. 25 is a side view illustrating a crimping terminal according to a comparative example that is obtainable after crimping. The first modified example differs from the above-described embodiment in that a core wire crimping portion 312A and a covering crimping portion 312B are individually crimped onto the core wire 51 and the covering 52.

As illustrated in FIG. 22, a crimping terminal 300 according to the first modified example includes a wire connection portion 312 and a joint portion 313. The wire connection portion 312 includes the core wire crimping portion 312A and the covering crimping portion 312B. The joint portion 313 joins a terminal connection portion (not illustrated) and the core wire crimping portion 312A. The core wire crimping portion 312A and the covering crimping portion 312B are provided at a distance in the first direction L. In other words, the crimping terminal 300 of the first modified example differs from the one that integrally covers the core wire 51 and the covering 52.

The core wire crimping portion 312A and the covering crimping portion 312B are formed into a U-shape similarly to the core wire crimping portion 12A and the covering crimping portion 12B of the above-described embodiment. An adhesive 320 is attached to the core wire crimping portion 312A. For example, the adhesive 320 is similar to the adhesive used in the water stop member 20 of the above-described embodiment. The adhesive 320 is attached to a rim portion on the joint portion 313 side of the core wire crimping portion 312A.

In a method of manufacturing a wire-provided crimping terminal of the first modified example, in the wire installation process, as illustrated in FIG. 23, the wire 50 is installed in the wire connection portion 312. The wire 50 is installed so that the core wire 51 is positioned in an inner space of the core wire crimping portion 312A, and the covering 52 is positioned in an inner space of the covering crimping portion 312B. Furthermore, in the wire installation process, the wire 50 is installed with the core wire 51 being in contact with the adhesive 320.

After the wire installation process is executed, the crimping process is executed. In the crimping process, the wire connection portion 312 is crimped onto the wire 50. The core wire crimping portion 312A is crimped onto the core wire 51, and the covering crimping portion 312B is crimped onto the covering 52. In the crimping terminal 300 of the first modified example, a mold for crimping the core wire crimping portion 312A and a mold for crimping the covering crimping portion 312B may be different molds.

As illustrated in FIG. 24, the core wire 51 is brought into contact with the adhesive 320 in the wire installation process. The adhesive 320 adheres to the core wire 51 to suppress the uplift of the core wire 51. This shortens a height Ht1 from the bottom portion of the core wire crimping portion 312A to the top portion of the core wire 51. In addition, the uplift of the core wire 51 is difficult to occur. Thus, the generation of the fray of the core wire 51 and biting of the core wire 51 in the crimping process is suppressed.

Similarly to the crimping terminal 300 of the first modified example, a crimping terminal 400 according to a comparative example illustrated in FIG. 25 includes a core wire crimping portion 412A and a covering crimping portion 412B. In a method of manufacturing a wire-provided crimping terminal of manufacturing the crimping terminal 400 of the comparative example, the adhesive 320 is not attached to the core wire crimping portion 412A. Thus, the uplift of the core wire 51 is easily generated, and a height Ht2 to the top portion of the core wire 51 easily becomes long. As a result, the fray of the core wire 51, biting of the core wire 51, and the like are easily generated in the crimping process. In addition, even if the adhesive 320 is attached to the core wire crimping portion 412A, unless the core wire 51 is brought into contact with the adhesive 320 in the wire installation process, a similar failure easily occurs.

Second Modified Example of Embodiment

A second modified example of the embodiment will be described. In the above-described embodiment, the attaching process is executed after the terminal connection portion shaping process. Alternatively, the terminal connection portion shaping process may be executed between the attaching process and the bending process. In other words, the attaching process may be executed at a stage at which both of the terminal connection portion 11 and the wire connection portion 12 have a flat plate shape.

The adhesive to be attached to the wire connection portion 12 or 312 in the attaching process is not limited to the one offering water stop performance or the one intended for water stop. For example, the adhesive may be the one intended for assuring positioning accuracy of the wire 50 with respect to the wire connection portion 12.

The shape and the position of the adhesive to be attached in the attaching process are not limited to those exemplified. In addition, a plurality of adhesives may be attached to the wire connection portion 12 or 312 in the attaching process.

The matters disclosed in the above-described embodiment and modified examples can be executed while being appropriately combined.

A method of manufacturing a crimping terminal according to the present embodiment includes a punching process of punching out a crimping terminal from a flat-plate-shaped metal base material, an attaching process of attaching a sheet-like adhesive to a wire connection portion being a portion in the terminal that is to be crimped onto a wire, and a bending process of bending the wire connection portion to which the adhesive is attached. According to the method of manufacturing a crimping terminal according to the present invention, by attaching the adhesive to the flat-plate-shaped wire connection portion, the adhesive can be appropriately attached. This brings about such an effect that a decrease in water stop performance in a crimping terminal can be suppressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A method of manufacturing a wire-provided crimping terminal, the method comprising:

a punching process of punching out a crimping terminal from a flat-plate-shaped metal base material, the crimping terminal including a wire connection portion that is in a flat-plate shape after punching out the crimping terminal, the wire connection portion being a portion in the crimping terminal that is to be crimped onto a wire having at least one exposed conductor;

an attaching process of attaching a sheet-like adhesive material to the wire connection portion when the wire connection portion is in the flat-plate shape;

a bending process of bending the wire connection portion to which the adhesive material is attached, the bending process bending the wire connection portion from the flat-plate shape into a U-shape;

placing the wire on the wire connection portion after the bending process; and crimping the wire connection portion onto the wire and thereby forming a water stop region with the adhesive material between opposing sides of the wire connection portion and blocking a clearance gap provided thereon from a distal end of the wire covering an end of the at least one exposed conductor.

2. The method of manufacturing a wire-provided crimping terminal according to claim 1, wherein the wire connection portion integrally covers a core wire and a covering of the wire by being crimped onto the wire, and in the attaching process, the adhesive material is attached to a rim portion in the wire connection portion along a longitudinal direction of the wire connection portion, and rim portions at both ends in the longitudinal direction of the wire connection portion.

3. The method of manufacturing a wire-provided crimping terminal according to claim 2, wherein the crimping terminal includes a terminal connection portion to be electrically-connected to a counterpart terminal, and a joint portion linking the terminal connection portion and the wire connection portion, and in the bending process, the wire connection portion and the joint portion are concurrently bent.

4. The method of manufacturing a wire-provided crimping terminal according to claim 1, wherein the crimping terminal includes a terminal connection portion to be electrically-connected to a counterpart terminal, and a joint portion linking the terminal connection portion and the wire connection portion, and in the bending process, the wire connection portion and the joint portion are concurrently bent.

* * * * *